US008834069B1

(12) United States Patent
Harvey

(10) Patent No.: US 8,834,069 B1
(45) Date of Patent: Sep. 16, 2014

(54) BUOYANCY COMPENSATION APPARATUS

(75) Inventor: Benjamin James Harvey, Wichita, KS (US)

(73) Assignee: Aequus, L.L.C., Wichita, KS (US)

( * ) Notice: Subject to any disclaimer, the term of this patent is extended or adjusted under 35 U.S.C. 154(b) by 7 days.

(21) Appl. No.: 13/541,485

(22) Filed: Jul. 3, 2012

(51) Int. Cl.
*B63C 11/02* (2006.01)
*B63C 11/08* (2006.01)

(52) U.S. Cl.
USPC ..... 405/186; 405/185; 405/193; 137/81.2; 137/505.11; 137/505.46; 441/88; 441/92

(58) Field of Classification Search
USPC ..... 405/185, 186, 193; 137/81.2, 505.11, 137/505.46, 907, 908, 116.3; 441/88, 90, 441/92, 94, 102
See application file for complete search history.

(56) References Cited

U.S. PATENT DOCUMENTS

| | | | | |
|---|---|---|---|---|
| 3,536,071 | A | 10/1970 | Barcelona et al. | |
| 3,727,250 | A | 4/1973 | Koehn et al. | |
| 3,747,140 | A | 7/1973 | Roberts et al. | |
| 3,866,253 | A | 2/1975 | Sinks et al. | |
| 3,938,511 | A | 2/1976 | Roberts | |
| 3,991,785 | A | 11/1976 | Trinkwalder | |
| 4,000,534 | A | 1/1977 | Cerniway et al. | |
| 4,016,616 | A | 4/1977 | Walters | |
| 4,137,585 | A | 2/1979 | Wright | |
| 4,226,257 | A | 10/1980 | Trinkwalder | |
| 5,542,446 | A * | 8/1996 | Rose | 137/81.2 |
| 5,560,738 | A * | 10/1996 | Noel | 405/186 |
| 5,788,415 | A | 8/1998 | Chen | |
| 5,997,216 | A * | 12/1999 | Kawashima | 405/186 |
| 6,592,298 | B2 * | 7/2003 | Beltrani | 405/186 |
| 6,722,819 | B2 | 4/2004 | Godoy | |
| 2002/0127062 | A1 * | 9/2002 | Biran et al. | 405/186 |
| 2006/0120808 | A1 * | 6/2006 | Roseborough | 405/186 |
| 2009/0250062 | A1 * | 10/2009 | Reynolds | 128/205.24 |
| 2012/0128425 | A1 * | 5/2012 | Walck | 405/186 |

* cited by examiner

*Primary Examiner* — John Kreck
*Assistant Examiner* — Carib Oquendo

(57) ABSTRACT

A buoyancy compensation apparatus for underwater use by a SCUBA diver, includes a pressurized air source, a buoyancy vest including air chambers and a pressure regulating unit. The pressure regulating unit includes a chamber in communication with the vest air chambers and the pressurized air source. The pressure regulating unit also includes a normally closed air injection valve and a normally closed relief valve. The wall of the pressure regulating unit chamber includes a flexible portion that flexes inwardly when outside water pressure exceeds the pressure in the vest air chambers, which, in turn, opens the air injection valve. The relief valve opens when air pressure in the vest air chambers exceeds outside water pressure. The air injection and relief valves respond faster than the walls of the buoyancy vest air chambers so that the volume of the vest air chambers remain generally constant even as the diver changes depth.

15 Claims, 21 Drawing Sheets

BUOYANCY COMPENSATION APPARATUS

FIELD

This invention relates to an apparatus for regulating the buoyancy of a SCUBA (Self-Contained Underwater Breathing Apparatus) diver.

BACKGROUND

A SCUBA (Self Contained Underwater Breathing Apparatus) diver must adjust his or her overall buoyancy to maintain generally neutral buoyancy. In order to be approximately neutrally buoyant, a diver may have ballast weights as part of his or her equipment. Further, a diver may also control the amount of air in his or her lungs as a means for making fine adjustments for achieving neutral buoyancy or for causing a small descent or ascent. A Buoyancy Control Device (BCD) is used by a diver, generally, to make significant adjustments to maintain neutral buoyancy as the diver changes depth. Although water density does not change significantly with depth, water pressure increases by approximately one atmosphere (roughly 14.6 lbs/in$^2$) for every 33 feet of depth. Air (and other gasses) responds to pressure and depth differently than liquids such as water. While fluids like water are essentially incompressible, gasses such as air are governed by Boyle's gas laws. Thus, when the pressure of a fixed mass of air in a flexible walled container is doubled, the volume of that air will be reduced by half. Prior art buoyancy control devices (BCDs) generally include a vest suitable for wearing by a SCUBA diver and the vest typically includes at least one air chamber and usually a set of air chambers having semi-flexible walls. In a prior art buoyancy control device (BCD), the diver, by means of a hand operated BCD valve, manipulates the valve between a normally closed condition in which air neither enters or leaves the BCD vest air chambers and two operational modes, namely: (1) a first mode in which air from a high pressure source (namely, a SCUBA air tank first stage regulator) flows into the BCD vest air chambers and (2) a second mode in which air is allowed to escape (valve off) from the BCD vest air chambers into the surrounding water. By manipulating such a prior art BCD valve, a skilled SCUBA diver is able to maintain near neutral buoyancy even while descending or ascending in the water column. This is accomplished, essentially, by keeping the volume of the air in the BCD vest air chambers generally constant (and thus the overall buoyancy of the diver and the diver's equipment generally constant) even as the pressure of that air in the vest air chambers varies greatly as the diver descends and ascends in the water column.

The manipulation of a present BCD is a skill that must be mastered by an aspiring SCUBA diver. To dive safely, a SCUBA diver, even when changing depth, must maintain an average buoyancy for himself or herself and his or her equipment (when considered together) that does not deviate significantly from a neutrally buoyant condition. As a diver descends, the pressure surrounding the air chambers of the BCD vest increases which causes the vest air chambers to decrease in volume. This decrease in volume decreases the amount of water being displaced by the diver and increases the average density of the diver and the diver's equipment. As this happens, the density of the surrounding incompressible water, does not change significantly with increasing depth. This decreases the buoyancy of the diver, resulting in a downward force that tends to increase the diver's rate of descent, which, in turn, causes the diver's buoyancy to decrease even faster. Accordingly, as the diver descends, the diver must constantly add air to the BCD air chambers to maintain their volume as depth increases in order to maintain neutral buoyancy. A reverse process occurs when the diver ascends. As the diver ascends, hydrostatic pressure surrounding the BCD vest air chambers decreases which allows the BCD air chambers to expand. When this happens, the water displaced by the diver increases as the average density of the diver including the diver's equipment decreases. Such an increase in displacement as the diver ascends causes the rate of ascent to increase resulting in a potentially dangerous runaway "buoyant ascent". Thus, during an ascent, the diver must constantly manipulate a prior art BCD valve to vent air from the BCD vest air chambers in order to maintain the BCD air chambers at a constant volume to maintain neutral buoyancy. During a scuba dive, a diver must continually and actively maintain neutral buoyancy when using a prior art BCD. What is needed is a buoyancy compensation apparatus that automatically traffics air into and out of the BCD vest air chambers to maintain generally neutral buoyancy.

SUMMARY

The above described need is addressed by a buoyancy compensation apparatus for underwater use by a SCUBA diver who has arranged his or her equipment so that the diver and the diver's equipment are generally neutrally buoyant upon entering a body of water at the beginning of a dive. The buoyancy compensation apparatus includes a pressure regulating unit and is operable to work in combination with a source of pressurized air and a BCD vest which includes at least one air chamber (hereafter referred to as "the BCD vest air chambers"). The pressure regulating unit is preferably mounted to the BCD vest at a location where it can be reached by the diver for manual manipulation. The pressurized air source is preferably the first stage of a SCUBA tank regulator well known by those skilled in the art. The pressure regulating unit includes an air injection valve and a relief valve structure. The pressure regulating unit is in pneumatic communication with the BCD vest air chambers. A normally closed air injection valve communicates between the first stage regulator and the pressure regulating unit. The air injection valve is mechanically associated with a flexible portion that is placed between the interior of the pressure regulating unit and the outside environment. The flexible portion deflects inwardly when the pressure in the chamber of the pressure regulating unit is less than the outside water pressure. When the flexible portion deflects inwardly, the air injection valve opens and air flows from the first stage regulator into the pressure regulating unit and into the BCD vest air chambers. This flow of pressurized air increases the pressure in the pressure regulating unit and the BCD vest air chambers and this flow of pressurized air continues until the difference in pressure is not large enough to open the air injection valve. The relief valve structure is at least indirectly in pneumatic communication with the BCD vest air chambers and is preferably placed between the interior of the pressure regulating unit and the outside environment. The relief valve structure opens and releases air from the BCD vest air chambers when the pressure in the BCD vest air chambers rises above the surrounding water pressure. The relief valve structure continues to release air from the vest air chambers until the pressure differential is no longer sufficient to force open the relieve valve structure.

DETAILED DESCRIPTION

Figure 1:
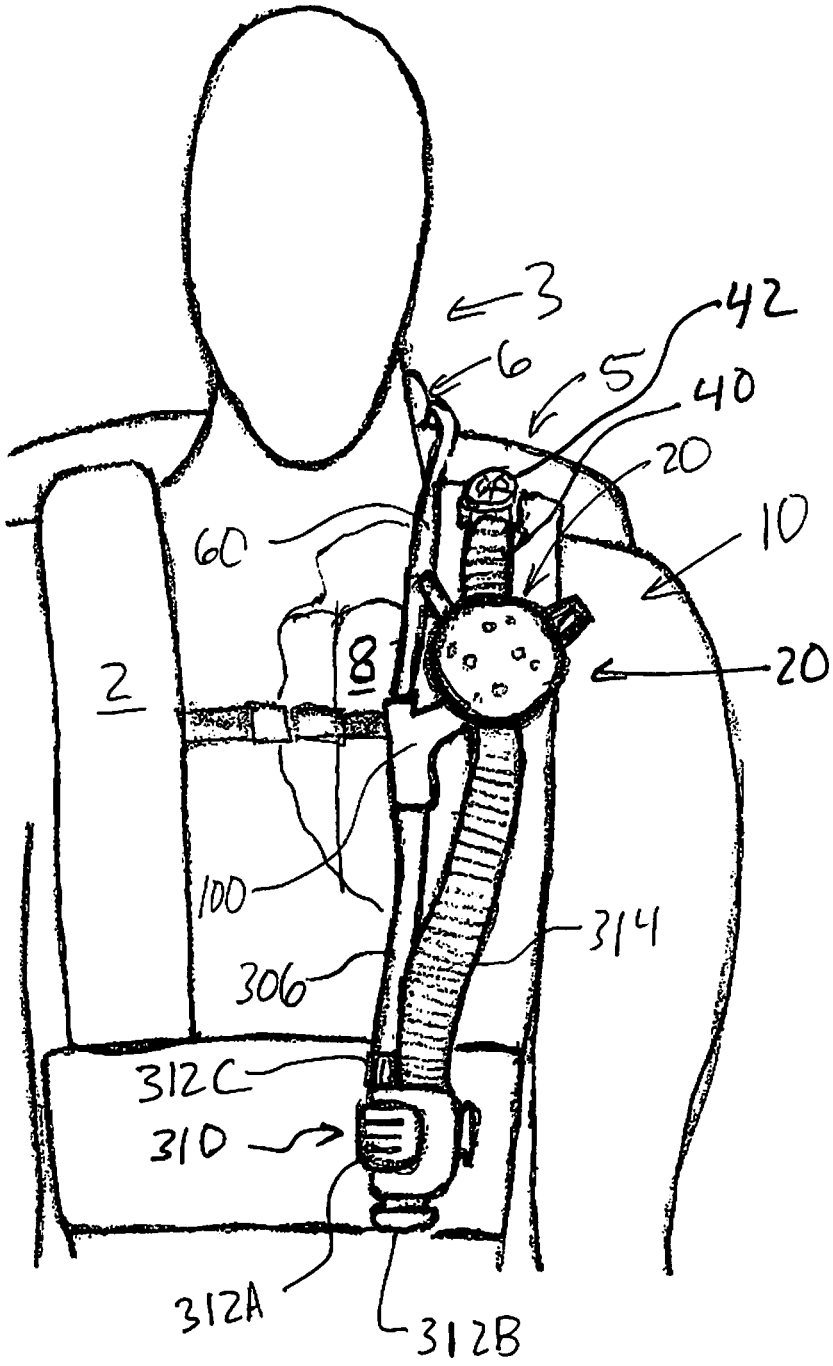
FIG. 1 is plan view of a SCUBA diver wearing a SCUBA air supply system and a buoyancy vest (BCD vest) equipped with a buoyancy compensation apparatus.

Referring to the Figures, FIG. 1 illustrates a buoyancy compensation apparatus 10 as installed with a buoyancy vest 2 which is worn by a SCUBA diver 3. As can be seen in FIG. 1, Diver 3 is also wearing other SCUBA equipment including a pressurized air tank 5 which includes a first stage regulator 6. First stage regulator 6 is a source of pressurized air which provides pressurized air for buoyancy compensation apparatus 10 as will be described in greater detail below. Buoyancy vest 2 includes a plurality of internal air tight interconnected air chambers 8. A pressure regulating unit 20 is fixed to the upper left front portion of vest 2. As can be seen in FIG. 1, first stage regulator 6 is connected by an air line 60 through an axis valve 100 to an injection valve 50 (shown in FIG. 2) that is integrated into pressure regulating unit 20. As is shown in FIG. 1, an air outlet line 40 connects between pressure regulating unit 20 and a connector 42. Connector 42 is used to establish a connection between outlet line 40 and chambers 8 of vest 2. The configuration and function of pressure regulating unit 20 will be described in detail below.

A back-up, optional, traditional buoyancy control device 310 of a type that is well known to those skilled in the art may be interposed between axis valve 100 and pressure regulation unit 20 as shown in FIG. 1. Traditional buoyancy control device 310 is connected to axis valve 100 by a line 306. Thus, traditional buoyancy control device 310 is in pneumatic communication with first stage regulator 6 and connects via an outlet line 314 to the internal chamber of pressure regulating unit 20. The internal chamber of unit 20 (chamber 22A1 shown in FIGS. 10 and 11) communicates with chambers 8 of vest 2 (through outlet 22A7 shown in FIG. 4D). Traditional buoyancy control device 310 has a first button 312A for opening an inflator valve for injecting air from line 306 into vest chambers 8 (through the path described above) and a second button 312B for opening a valve for venting air from vest chambers 8 into the surrounding water. The connection between line 306 and traditional buoyancy control device 310 is preferably a quick disconnect 312C so that if inflator valve button 312A becomes stuck in an open position, the diver can take device 310 off line. As will be described below, the elements of pressure regulating unit 20 that control the injection of air into vest air chambers 8 and the release of air from vest air chambers 8 may be adjusted to a closed position. Thus, a diver, with the arrangement shown in FIG. 1, is able to take pressure regulating unit 20 off line (by closing it) and instead rely on optional traditional buoyancy control device 310 to manually adjust his or her buoyancy.

Pressure regulating unit 20 is crucial to the operation of buoyancy compensation apparatus 10. Pressure regulating unit 20 has pressure responsive structures, which in this example include an injection valve associated with a pressure responsive flexible member and a pressure relief portion. The injection valve that is associated with the flexible member injects air into air chambers 8 when internal air pressure falls below the external water pressure. The pressure relief portion releases air from air chambers 8 when external pressure exceeds the external water pressure. More particularly, in this example, when the air pressure in chambers 8 of buoyancy vest 2 falls below the pressure of the surrounding water by a sufficient amount, a flexible pressure sensitive member associated with pressure regulating unit 20 deflects inwardly and urges open an air injection valve. The air injection valve is connected to first stage regulator 6. When the injection valve opens, air enters chambers 8 which causes the pressure in chambers 8 to equalize with the surrounding water pressure. When the air pressure in chambers 8 of buoyancy vest 2 rises above the pressure of the surrounding water to a sufficient degree, a pressure relief portion of pressure regulating unit 20 opens in response to the positive internal pressure. When the pressure relief portion opens, air from chambers 8 escapes into the surrounding water. This causes the pressure in chambers 8 to equalize with the surrounding water pressure. Both processes have the effect of generally maintaining chambers 8 at a constant volume, regardless of the pressure changes that occur when the diver moves up and down in the water column. This is the case because chambers 8 are not so flexible that they immediately change volume in response to pressure changes. Because chambers 8 remain at a generally constant volume as pressure regulating unit 20 either injects or vents air to equalize pressure, the overall buoyancy of the diver remains generally constant. The specific pressure responsive structures described below for pressure regulating unit 20 are merely examples of a injection valve that may be used to accomplish these desired responses.

In this example, pressure regulating unit 20 is preferably mounted to the left side of buoyancy vest 2 for ease of access and manipulation by a right handed diver. (A reverse arrangement may be considered for a left handed diver.) Diver 3 shown in FIG. 1 has preferably arranged his or her equipment to achieve generally neutral buoyancy at the beginning of a dive. The function of a typical, prior art buoyancy vest is to enable diver 3 to adjust his or her overall buoyancy by either directing air from the first stage regulator into air chambers 8 of vest 2 or by venting air from air chambers 8 of vest 2 into the surrounding water. With prior art devices, these operations are performed by manipulating a BCD that has two control buttons such as optional BCD 310 which, in this example, is added to buoyancy control apparatus 10 as a back-up as described above.

Figure 2:
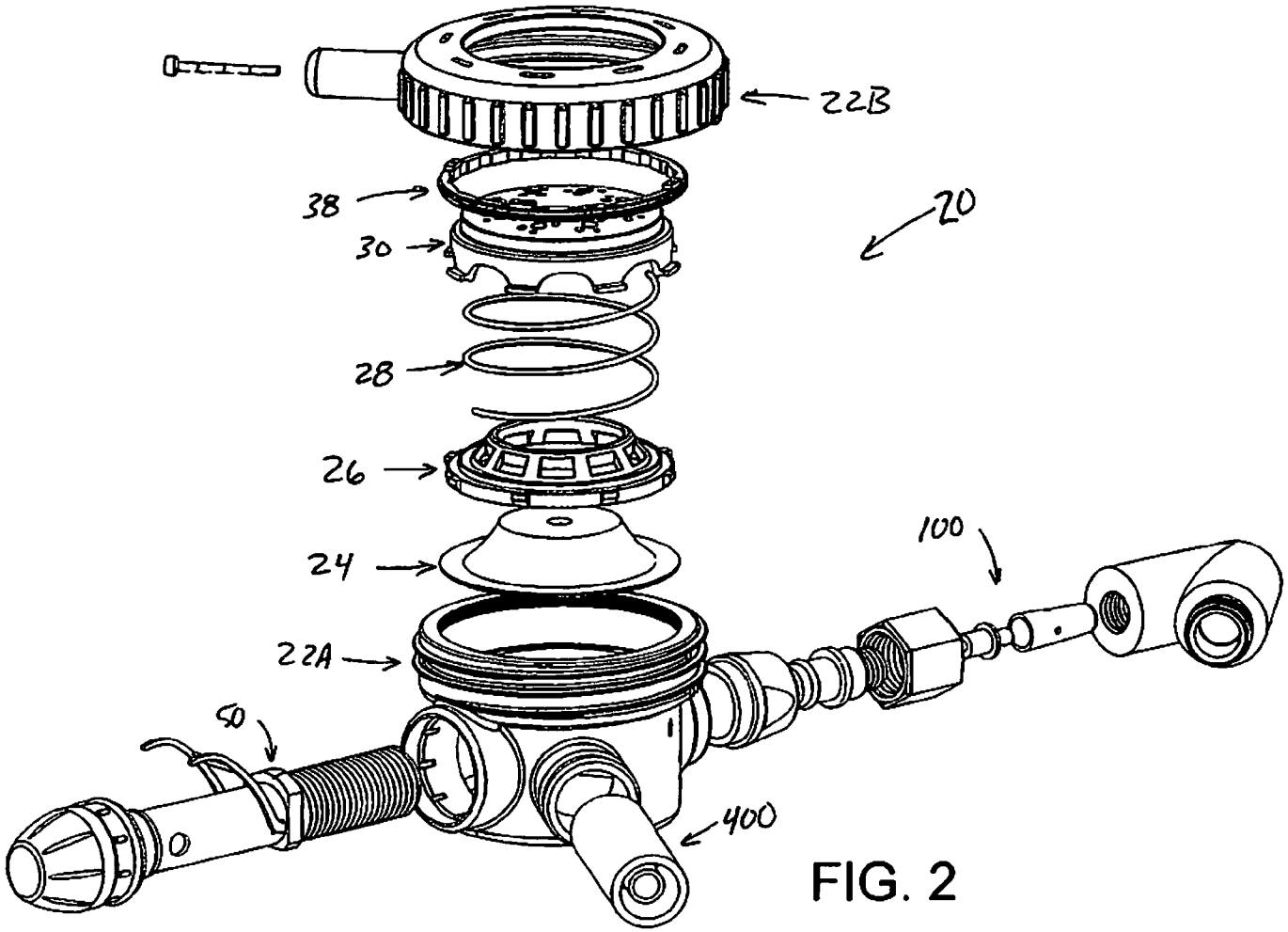
FIG. 2 is an exploded perspective view of a pressure regulating unit and an axis valve assembly.

FIG. 2 provides an exploded perspective view of pressure regulating unit 20. As can be seen in FIG. 2, pressure regulating unit 20 includes, a housing 22 which further includes a base 22A and a cap 22B. Pressure regulating unit further includes a diaphragm 24, a diaphragm basket 26, a spring 28, a plunger 30, a safety clip 38 and an injection valve 50. FIGS. 4A through 9D provide various views of the components of pressure regulating unit 20. FIGS. 4A-4D illustrate base 22A of housing 22 and FIGS. 5A-5E illustrate cap 22B of housing 22. FIGS. 6A-6E illustrate plunger 30. FIGS. 7A-7D illustrate diaphragm basket 26. FIGS. 8A-8D illustrate diaphragm 24. FIGS. 9A-9D illustrate injection valve 50. Preferably base 22A, cap 22B, and diaphragm basket 26 are all fashioned from relatively tough, rigid plastic which can be most economically fashioned in large quantities by injection molding. Plunger 30 is preferably fashioned from a flexible plastic. Plunger 30 can also be produced in large quantities most economically with injection molding. Diaphragm 24 is preferably fashioned from a very flexible rubber but has a rigid plastic disc attached to its crown as will be described below.

Figures 4A, 4B, 4C, 4D:
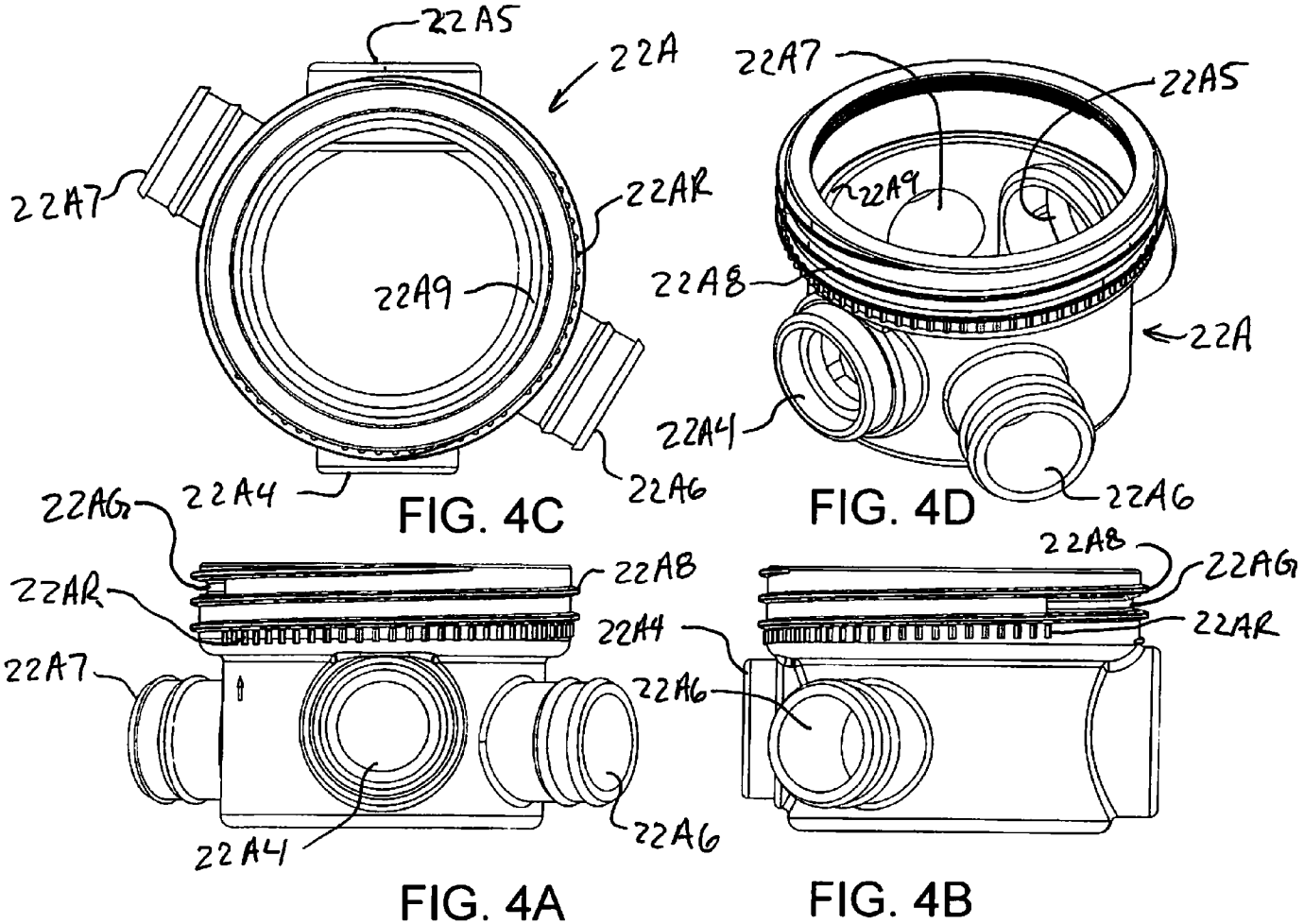
FIG. 4A is a side view of the base portion of a pressure regulating unit housing.
FIG. 4B is a second side view of the base portion of a pressure regulating unit housing.
FIG. 4C is a top view of the base portion of a pressure regulating unit housing.
FIG. 4D is a perspective view of the base portion of a pressure regulating unit housing.
Figures 5A, 5B, 5C, 5D, 5E:
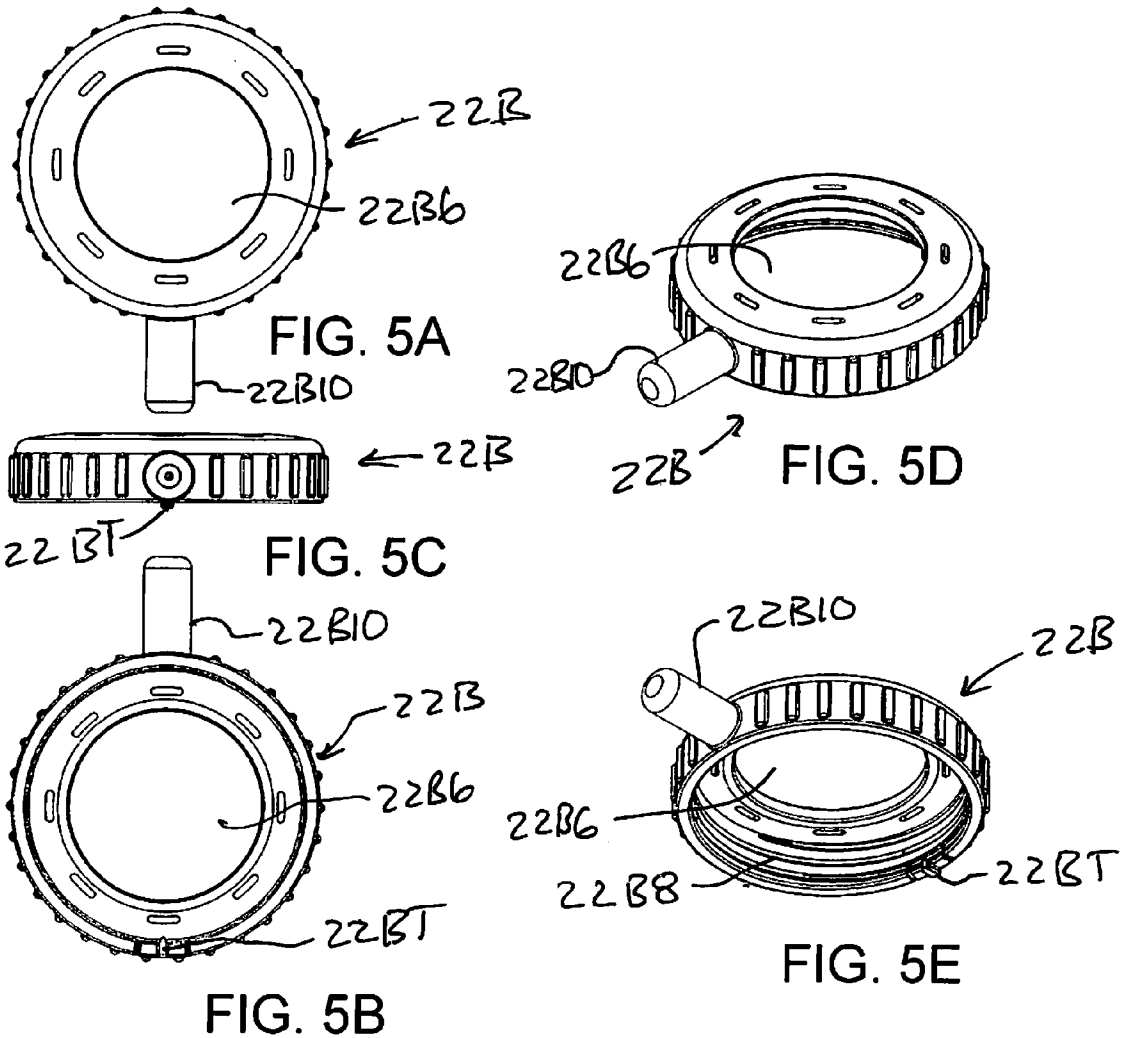
FIG. 5A is a top view of the cap portion of a pressure regulating unit housing.
FIG. 5B is a bottom view of the cap portion of a pressure regulating unit housing.
FIG. 5C is a side view of the cap portion of a pressure regulating unit housing.
FIG. 5D is a first perspective view of the cap portion of a pressure regulating unit housing.
FIG. 5E is a second perspective view of the cap portion of a pressure regulating unit housing.
Figure 6D:
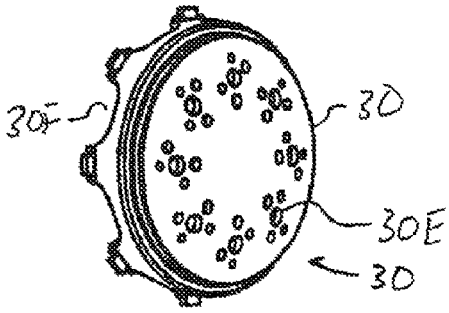
FIG. 6D is a perspective view of the plunger of a pressure regulating unit.
Figure 6B:
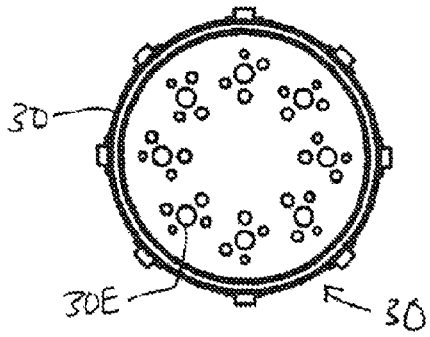
FIG. 6B is a top view of the plunger of a pressure regulating unit.
Figure 6A:
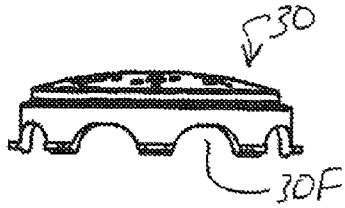
FIG. 6A is a side view of the plunger of a pressure regulating unit.
Figure 6E:
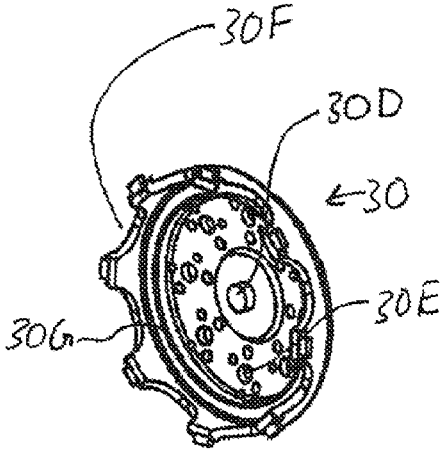
FIG. 6E is a second perspective view of the plunger of a pressure regulating unit.
Figure 6C:
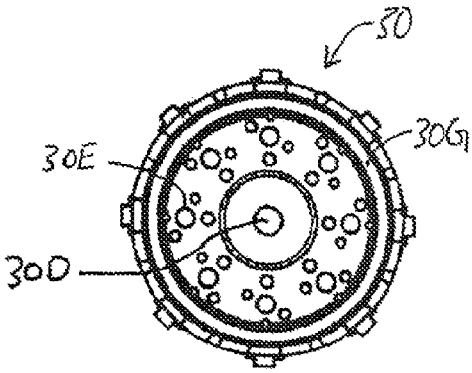
FIG. 6C is a bottom view of the plunger of a pressure regulating unit.
Figure 7D:
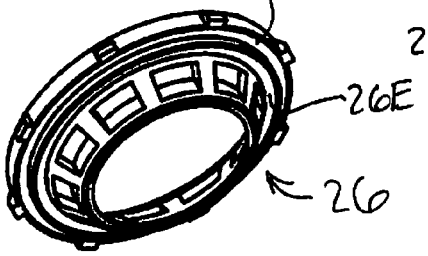
FIG. 7D is a perspective view of the diaphragm basket of a pressure regulating unit.
Figure 7B:
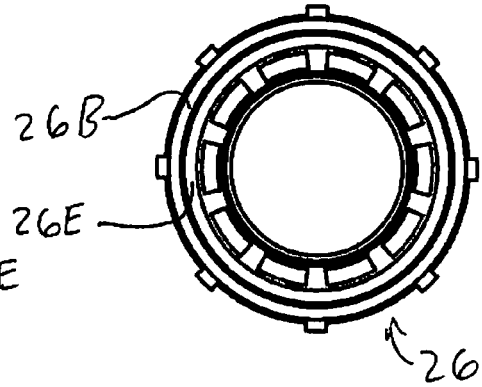
FIG. 7B is a top view of the diaphragm basket of a pressure regulating unit.
Figure 7A:
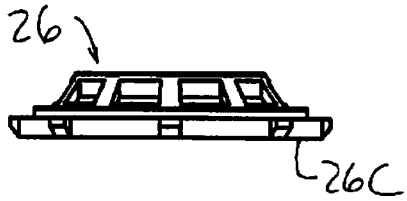
FIG. 7A is a side view of the diaphragm basket of a pressure regulating unit.
Figure 7C:
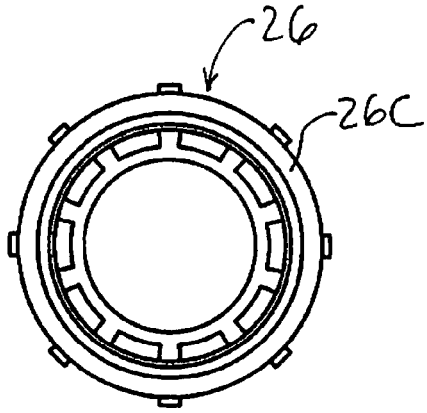
FIG. 7C is a bottom view of the diaphragm basket of a pressure regulating unit.
Figure 10:
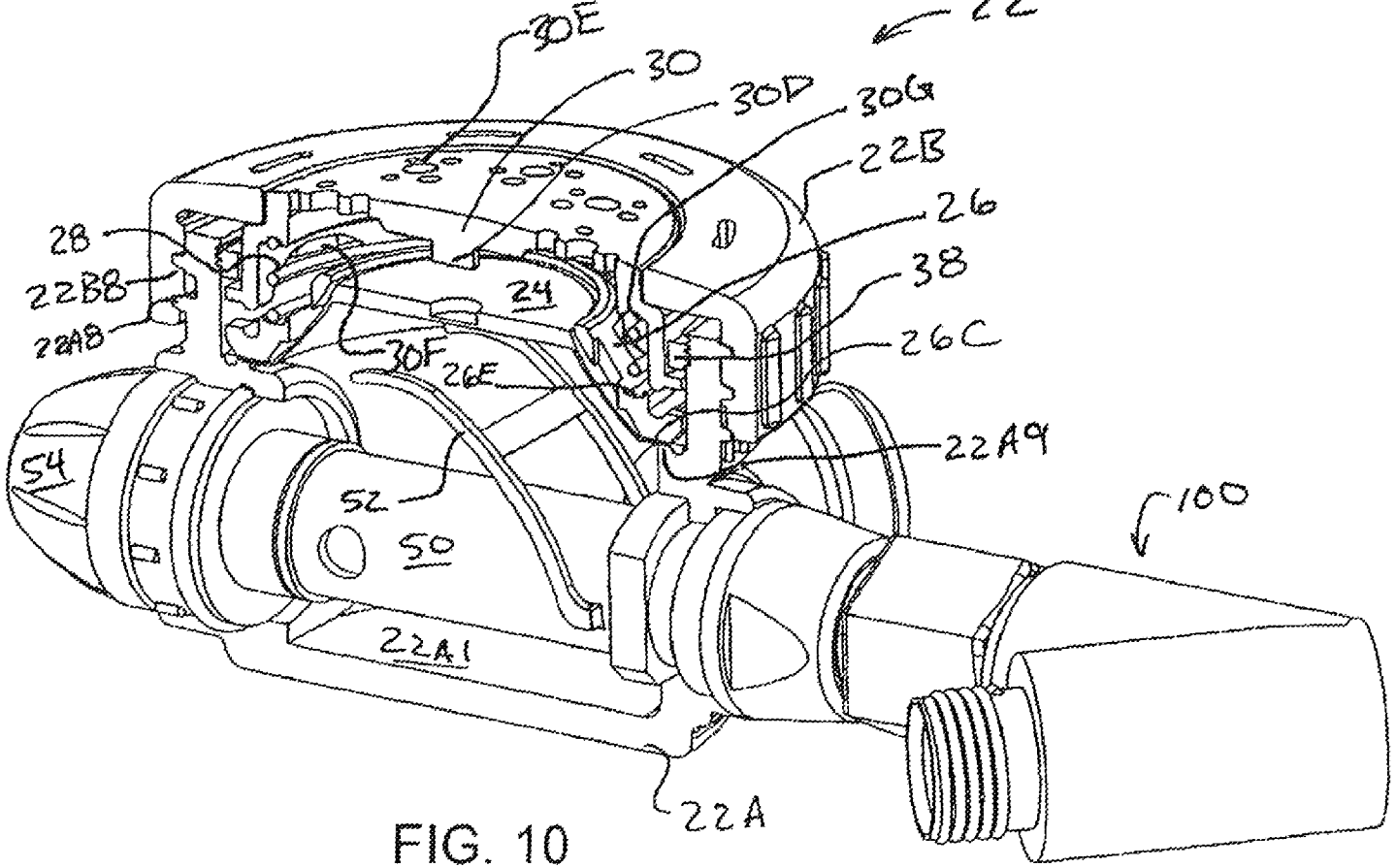
FIG. 10 is a cross-sectioned perspective view of a pressure regulating unit with the cap adjusted to the open position and with the diaphragm seated on the base of the pressure regulating unit housing.

As can be best seen in FIGS. 4D and 10, in this example, base 22A is generally cylindrical and presents a generally cylindrical interior volume 22A1. The cylindrical wall of base 22A also includes four ports. A pair of injection ports, 22A4 and 22A5 cooperate to accommodate generally cylindrical injection valve 50 shown in FIGS. 9A-9D. Ports 22A4 and 22A5 and injection valve 50 are sized and shaped to form air tight seals with each other. Of the two remaining ports, a BCD port 22A6 connects via line 314 (shown in FIG. 1) to prior art BCD 310. A vest chamber port 22A7 provides a passageway for the flow of air between interior volume 22A1 of housing 22 through outlet line 40 shown in FIG. 1 and into air chambers 8 of vest 2. As can be seen in FIG. 4D base 22A is closed at one end and is open at its opposite end. The open end is surrounded by external threads 22A8. External threads 22A8 correspond to internal threads 22B8 of cap 22B shown in FIG. 5E. In this example, as can be seen in FIGS. 4C and 4D, base 22A presents a continuous ledge 22A9 that extends around the upper end of the inside wall of base 22A.

Figure 13:
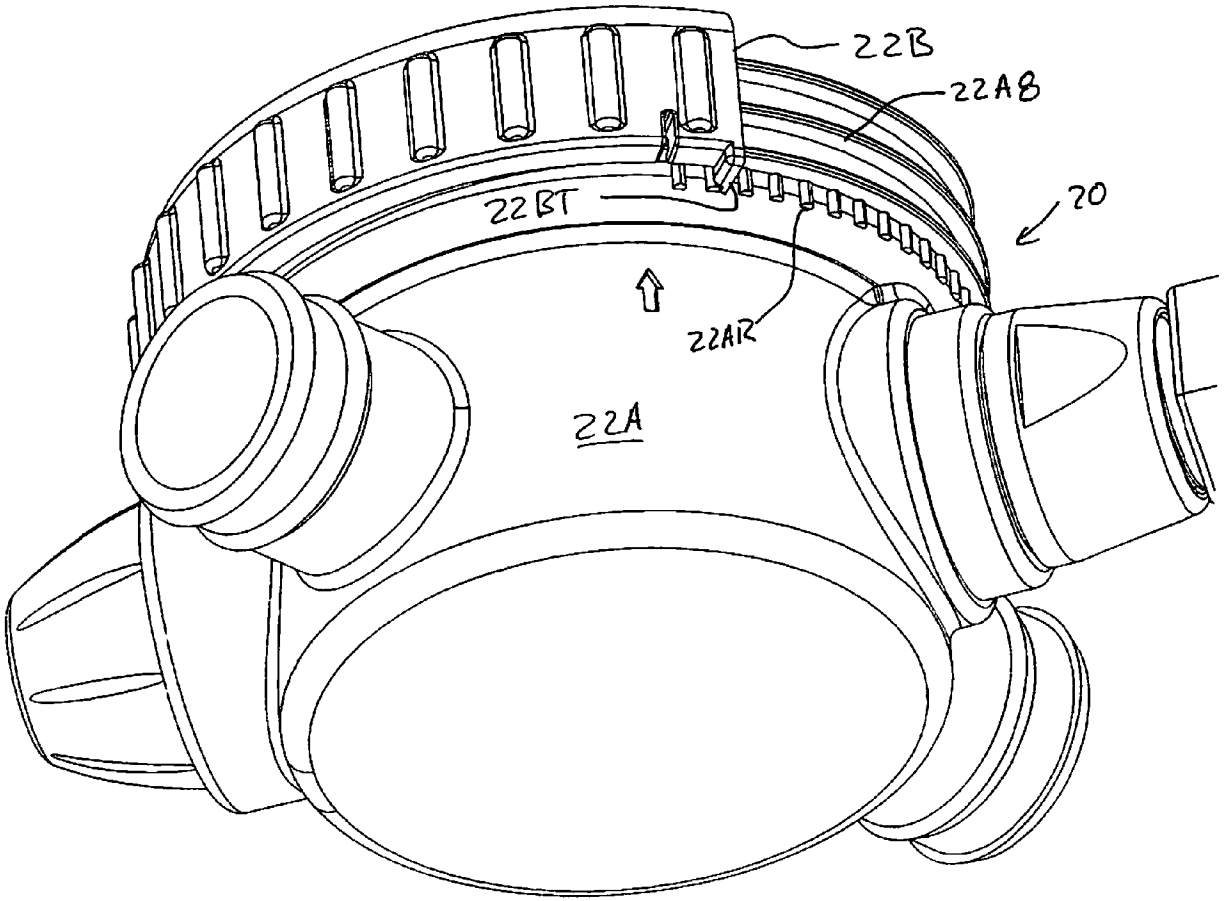
FIG. 13 is perspective view of the pressure regulating unit shown the cap partially sectioned away to reveal a tab extending from the cap that contacts a series of ridges formed into the base portion.
Figure 14:
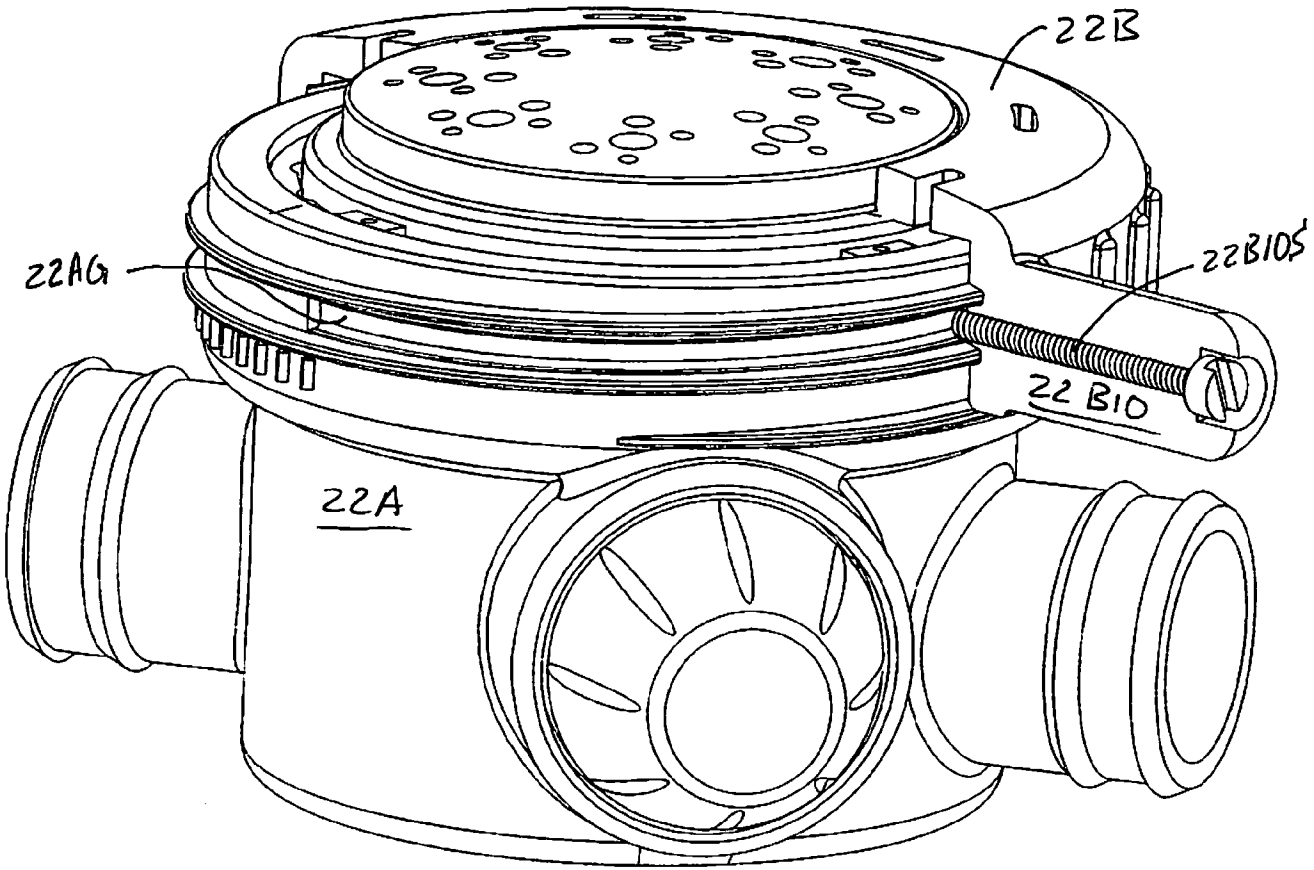
FIG. 14 is perspective view of the pressure regulating unit shown the cap partially sectioned away to reveal a retaining screw carried by the handle.

Cap 22B, which is shown in FIGS. 5A-5E, has internal threads 22B8 operable for engaging the external threads 22A8 of base 22A. Preferably, these corresponding threads have large pitch so that less than one revolution of cap 22B results in the displacement shown between FIG. 10 and FIG. 11. Still further, in this example base 22A has a series of ridges 22AR which can be best seen in FIG. 13. As shown in FIG. 13, ridges 22AR are arranged around the outside wall of base 22A directly under the lowest thread 22A8. Cap 22B, in this example carries a flexible tab 22BT that audibly clicks as it encounters ridges 22AR. Tab 22BT and ridges 22AR are arranged so that tab 22BT encounters ridges 22AR and audibly clicks as cap 22B is turned from the open position shown in FIG. 10A to the closed position shown in FIG. 11. This allows the diver to hear the progress of cap 22B as it is turned from an open position to a closed position. As can be seen in FIGS. 5A-5E, cap 22B includes a large central opening 22B6. Central opening 22B6 is shaped and sized to accommodate plunger 30 as will be described in greater detail below. Cap 22B has a small handle 22B10 (shown in FIGS. 5A-5E) projecting from its outside surface. As shown in FIG. 14, in this example, handle 22B10 carries a set screw 22B10S that is threaded into handle 22B10. Set screw 22B10S extends from the inside wall of cap 22B to engage a corresponding groove 22AG which is disposed around the outside surface of base 22A between external threads 22A8. Groove 22AG is limited in length such that the end of the groove catches the extended set screw 22B10S if a diver attempts to turn cap 22B past the open position shown in FIG. 10A. This prevents a diver from unintentionally removing cap 22B during a dive. An accidental removal of cap 22B at depth could cause pressure regulating unit 20 to disassemble. This would cause an uncontrolled escape of air from the air chambers of vest 2 and a sudden loss of buoyancy.

In order to understand pressure regulating unit 20, it is useful to consider its two main functions and how the various elements of pressure regulating unit 20 work to accomplish those functions. One important function is to release air from air chambers 8 of vest 2 when the pressure in vest air chambers 8 is higher than the ambient water pressure. This function allows the diver to maintain neutral buoyancy even when the diver is ascending in the water column.

FIG. 10 shows pressure regulating unit 20 with cap 22B in a first open position. As can be seen in FIG. 10, cap 22B has internal threads 22B8 that engage corresponding external threads 22A8 of base 22A. As described above, a set screw 22B10S is integrated in 22B10 of cap 22B prevents cap 22B from completely disengaging from base 22A. As noted above, it is important that set screw 22B10S is effective since it should be rendered impossible or at least very difficult for a diver to unintentionally remove cap 22B from base 22A during a dive. As cap 22B is turned to further engage the corresponding threads, cap 22 eventually reaches a closed position shown in FIG. 11.

Figure 11:
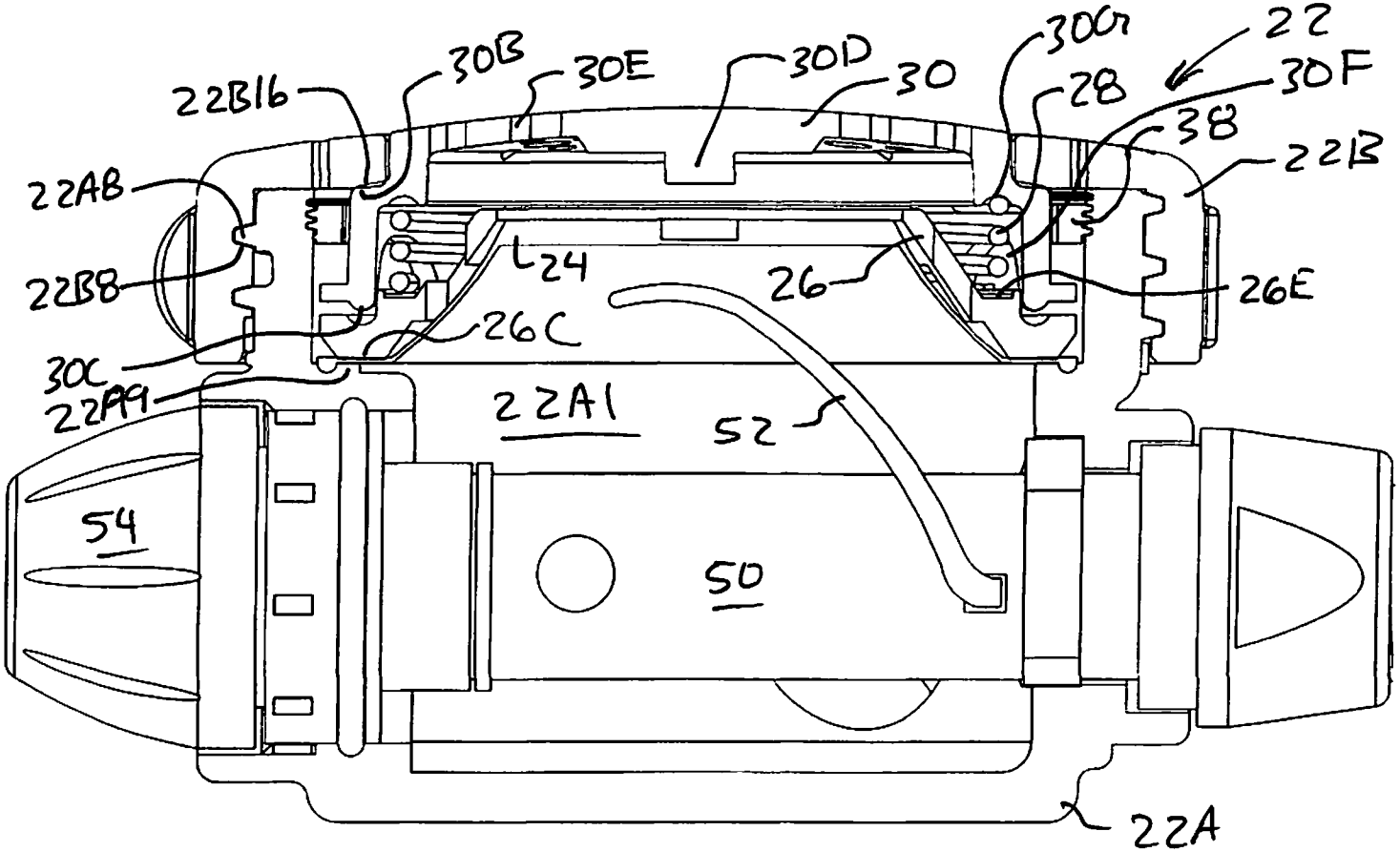
FIG. 11 is a cross-sectioned view of the pressure regulating unit with the cap adjusted to the closed position.

When cap 22 is in the closed position shown in FIG. 11, diaphragm 24 forms a seal with base 22A. When this occurs the interior volume of pressure regulating unit 20 becomes sealed with respect to the surrounding environment. When in the closed position, in this example, there is still a gap between the lower surface of plunger 30 and basket 26. However, since spring 28 is compressed, enough force is being applied to the periphery of basket 26 so that the lower surface 26C of basket 26 applies enough pressure to diaphragm 24 to keep diaphragm 24 seated on ledge 22A9 of base 22A. Accordingly, when cap 22 is threaded down to the closed position, as shown in FIG. 11, the outer flange of diaphragm 24 remains in contact with ledge 22A9. The sealing contact of diaphragm 24 when pressure regulating unit 20 is in the closed position shown in FIG. 11 remains effective because connector 42 which connects directly to chambers 8 of vest 2 (shown in FIG. 1) includes a relief valve structure (not shown) that vents air from air chambers 8 of vest 2 before the differential positive pressure is large enough to unseat diaphragm 24 from ledge 22A9 when pressure regulating unit 20 is in the closed position shown in FIG. 11. Connector 42 shown in FIG. 1 is of a type well known to those skilled in the art and the relief valve (a flap valve) present in connector 42 is also of a type that is well known to those skilled in the art.

Figure 10A:
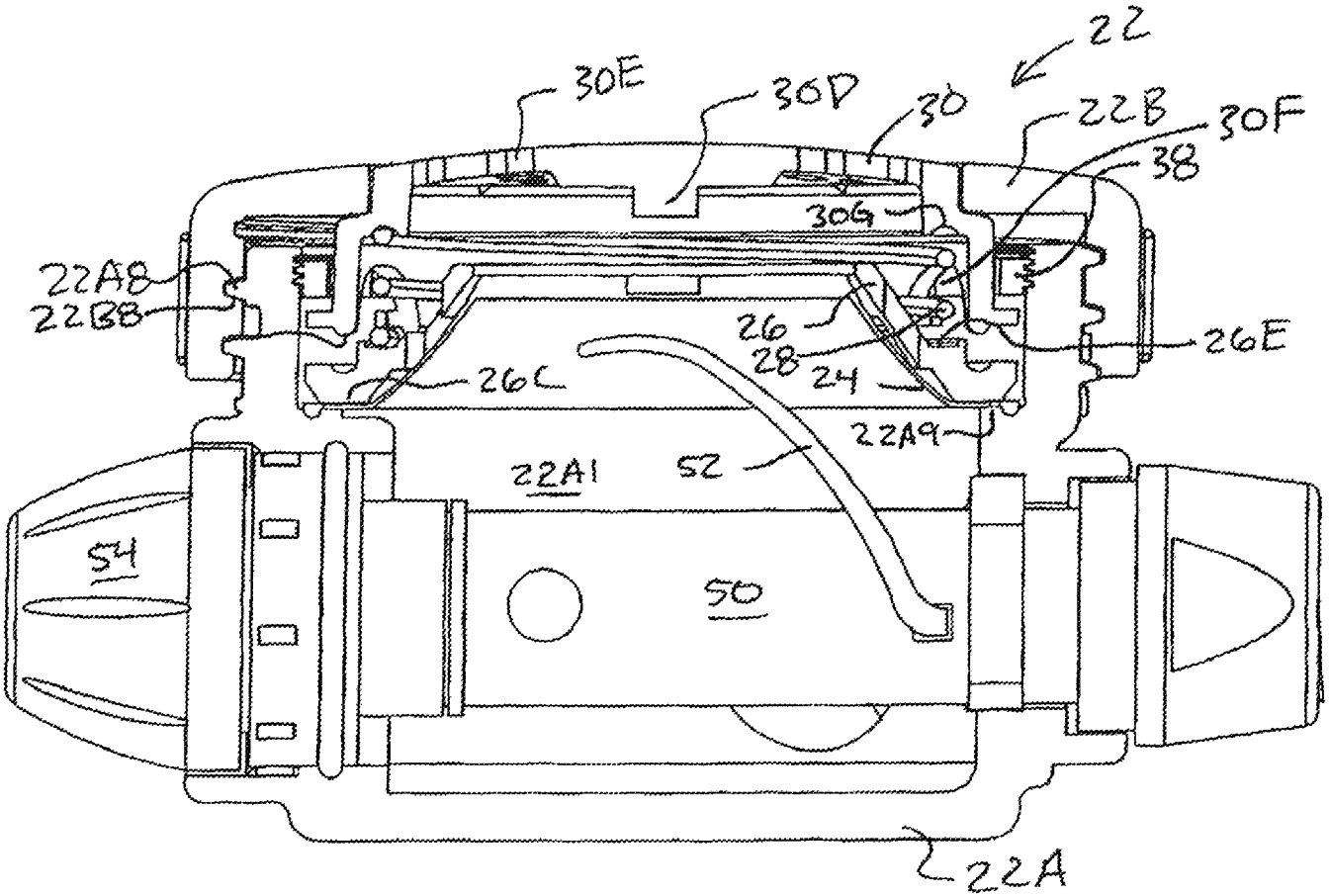
FIG. 10A is a cross-sectioned view of a pressure regulating unit with the cap adjusted to the open position.
Figure 10B:
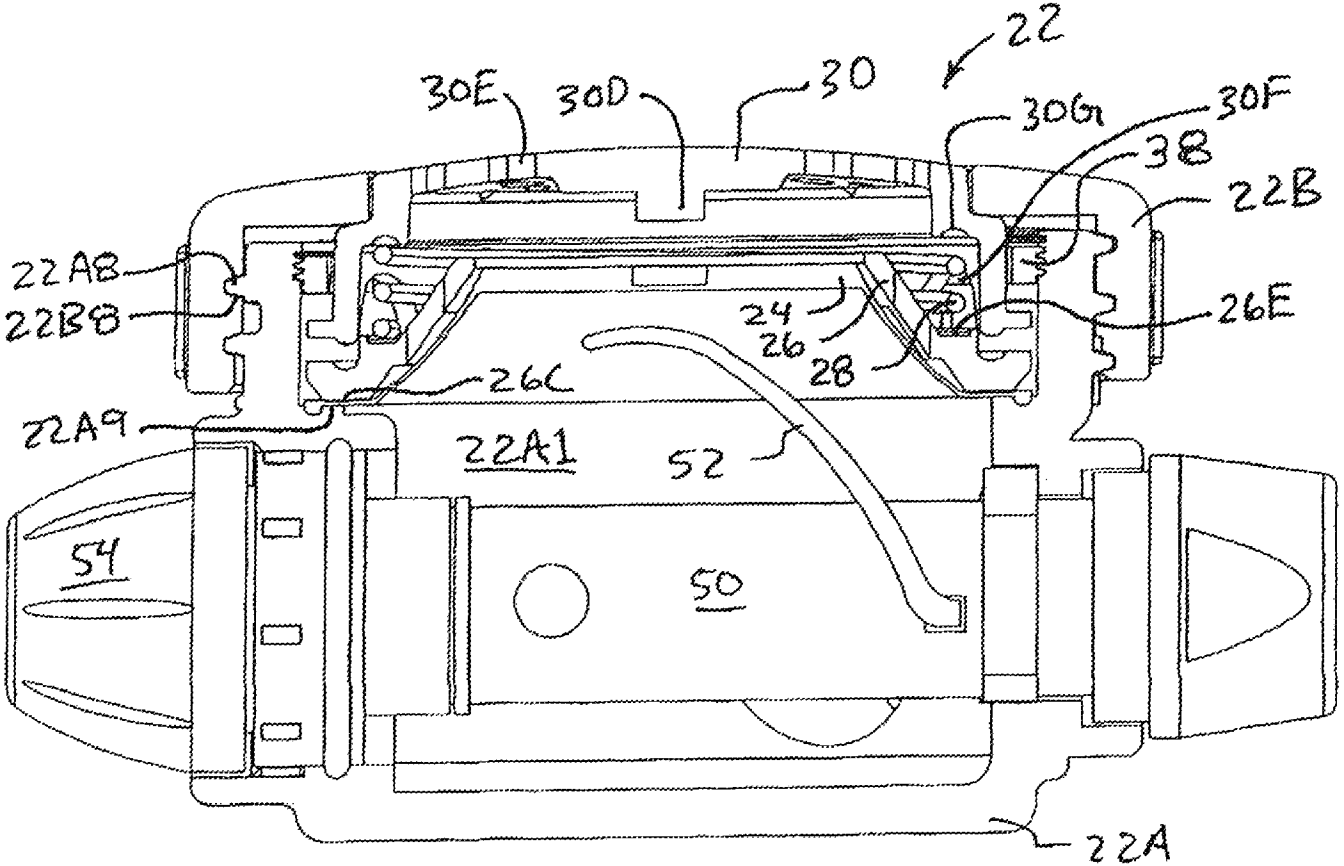
FIG. 10B is a cross-sectioned view of a pressure regulating unit with the cap adjusted to the working position which is between the open position and the closed position and with the diaphragm seated on the base of the pressure regulating unit housing.
Figure 10C:
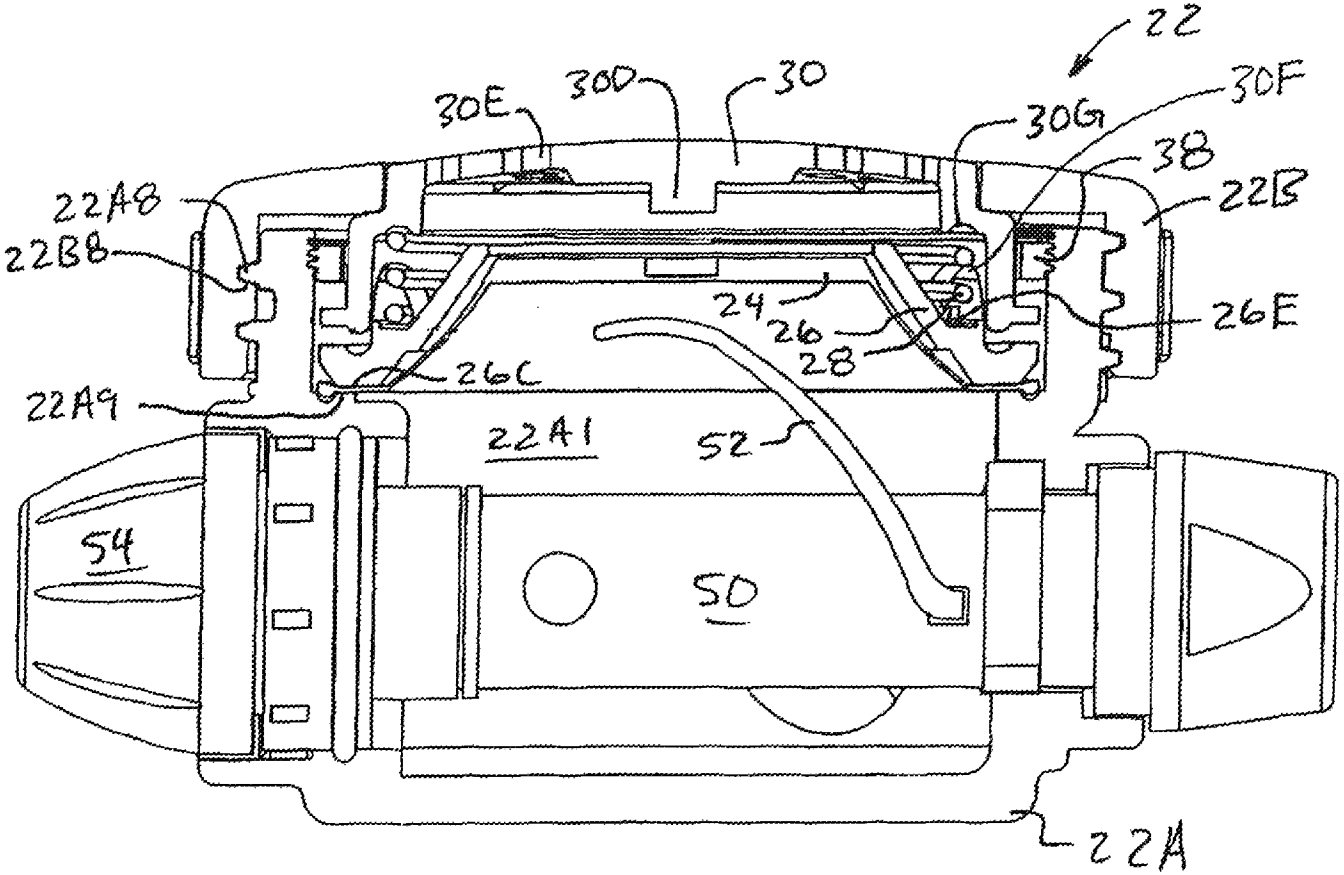
FIG. 10C is a cross-sectioned view of a pressure regulating unit with the cap adjusted to the working position and with the diaphragm unseated from the base of the pressure regulating unit housing as air escapes from the pressure regulating unit housing.
Figure 10D:
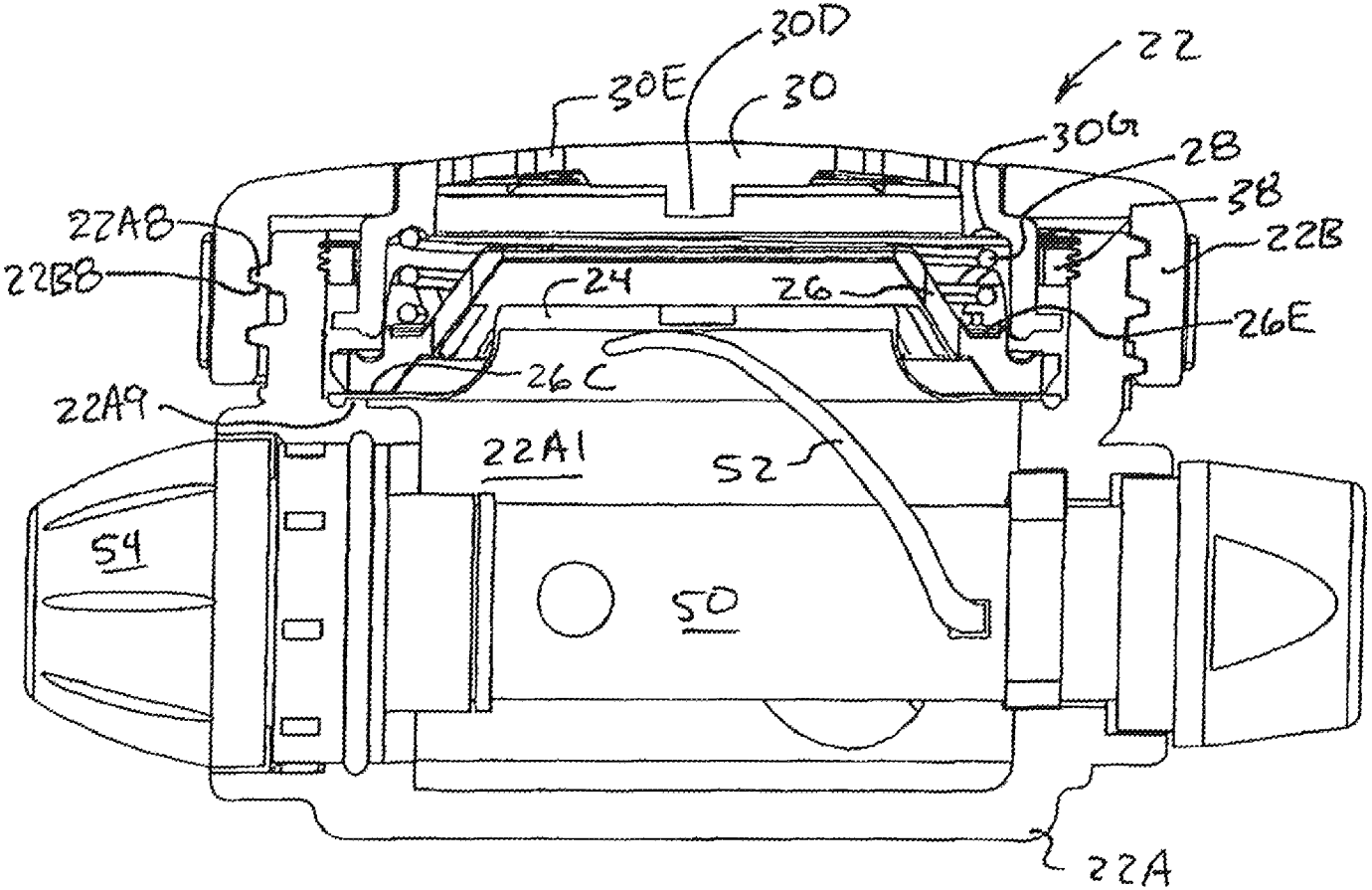
FIG. 10D is a cross-sectioned view of a pressure regulating unit with the cap in the working position and showing the diaphragm deflected inwardly as a result of positive external pressure thereby deflecting the lever of the injection valve causing the injection valve to open and inject air into the pressure regulating unit.
Figure 10E:
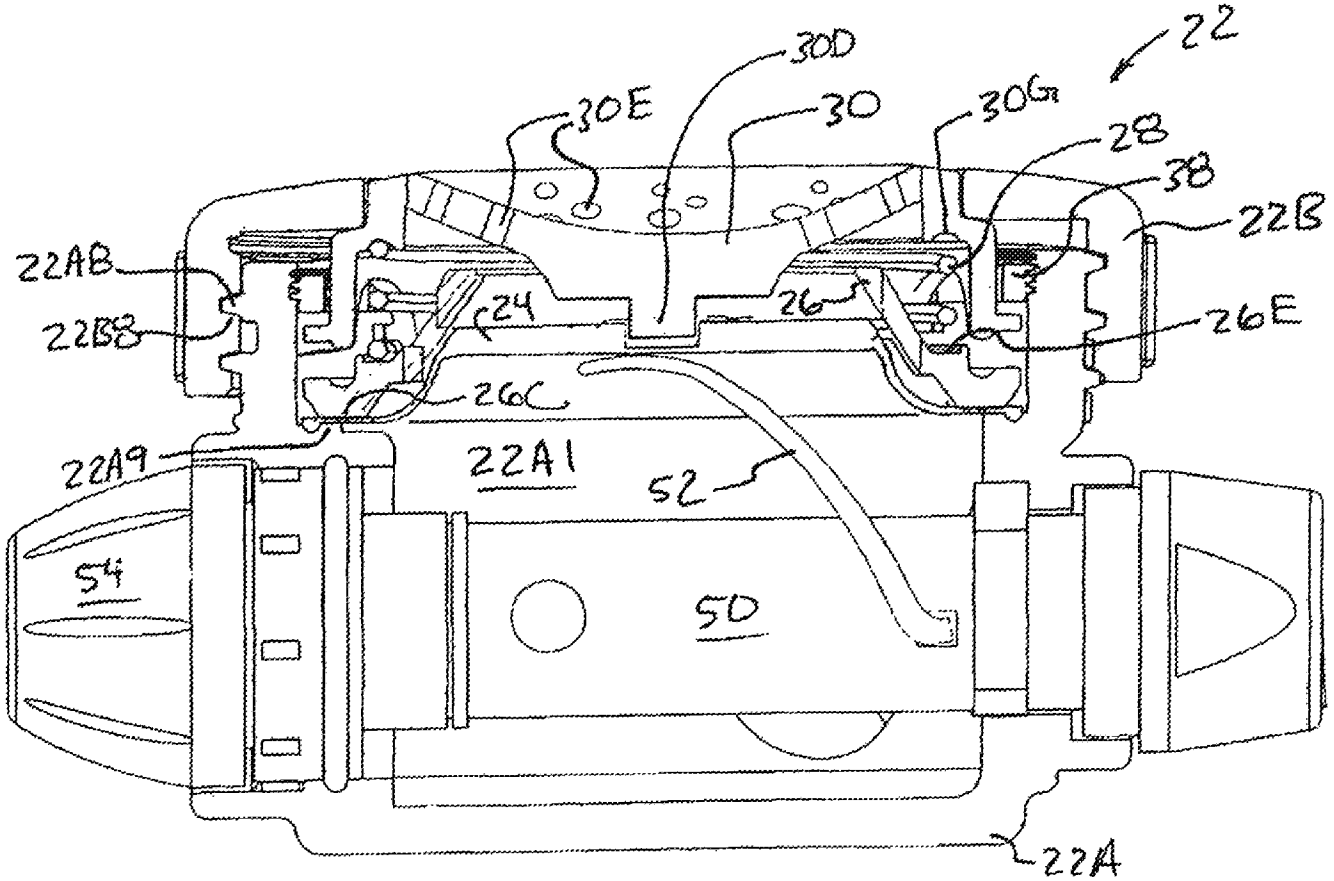
FIG. 10E is a cross-sectioned view of a pressure regulating unit with the cap adjusted to the open position, with the diaphragm seated on the base of the pressure regulating unit housing and with the diaphragm deflected inwardly as a result of external manual pressure which in turn causes the movement of the air injection valve lever thereby causing the air injection valve to open and inject air into the pressure regulating unit.

As shown in FIG. 10E, it is also possible for a diver to push in on plunger 30. Plunger 30 is fashioned from a flexible material. When a diver pushes in on plunger 30 a central projection 30D of plunger 30 pushes through the central opening of diaphragm basket 26 and presses on the center of diaphragm 24. In this example, the thick flat center portion of diaphragm 24 is relatively rigid. However, the skirt portion surrounding the flat central portion of diaphragm 24 is very flexible, so that the center portion will contact the end of lever 52. This contact causes lever 52 to pivot and open injection valve 50. Recall that when pressure regulating unit 20 is in the closed position shown in FIG. 11, chamber 22A1 is generally closed to the outside environment but still open to chambers 8 of vest 2. Thus, when valve 50 opens, air flows into chamber 22A1 and from there flows into chambers 8 of vest 2. Thus, when unit 20 is in the closed position, it is possible for a diver to inflate the vest (at least to the extent that the vest can be inflated with a prior art BCD device given the relief valve present in connector 42) by pressing the center of plunger 30 in order to use the vest as a flotation device. This would be most commonly done when the diver is on the surface and wishes to stay on the surface such as might occur at the end of a dive. Closing pressure regulating unit 20 and pressing plunger 30 should not be done at depth because doing so might cause an unwanted and dangerous buoyant ascent.

When pressure regulating unit 20 is in the open position shown in FIGS. 10 and 10A, or in the operating position shown in FIGS. 10B and 10C, pressure regulating unit 20 is able to vent air from chambers 8 of vest 2 into the surrounding water. This is particularly useful when the diver ascends from depth. As the diver ascends, the surrounding water pressure decreases. This causes the air in vest chambers 8 to be at a higher pressure than the surrounding water. If the rising air pressure in vest air chambers 8 is not partially relieved to maintain an approximate equilibrium between vest air chambers 8 and the surrounding water, vest air chambers 8 will expand and the diver will experience an unwanted buoyant ascent. To counter this, if pressure regulating unit 20 is set between the closed position shown in FIG. 11 and the open position shown in FIG. 10, that is, for example, in the operating position shown in FIGS. 10B and 10C, pressure regulating unit 20 provides a pressure relief portion for venting air when the internal vest air chamber pressure exceeds the external water pressure. In this example, the pressure relief portion includes diaphragm 24 and diaphragm basket 26 which generally holds diaphragm 24 as well as spring 28 that extends between cap 22B and diaphragm basket 26. When internal pressure within chamber 22A1 exceeds external pressure by a sufficient amount, the pressure on the internal side of diaphragm 24 and diaphragm basket 26 will overcome the force applied by spring 28 so that diaphragm 24 lifts away from ledge 22A9 of base 22A as shown in FIG. 10C. This action allows air from chamber 22A1 (and by extension from vest air chambers 8) to flow around diaphragm 24 and escape into the surrounding water. As can be seen in FIG. 10C, the gap between diaphragm 24 and ledge 22A9 is very small, but this gap around the periphery of diaphragm 24 is sufficient to allow air to escape. Air flowing around the edges of diaphragm 24 will flow through side ports 30F in the side walls of plunger 30, in under plunger 30 and out through holes 30E in the upper wall of plunger 30 and into the surrounding water. Generally, this higher pressure air will escape from pressure regulating unit 20 before air chambers 8 of vest 2 are able to expand. The differential pressure required to allow such an escape of air is determined by the magnitude of the spring force exerted by spring 28 on basket 26. In this example, spring 28 has a diameter of approximately 1.4 inches, a height of approximately 0.75 inches and a spring constant of roughly 1.25 lbs./inch. As can be best understood with reference to FIGS. 2, 10 and 10A, spring 28 extends between plunger 30 and basket 26 and more particularly, its top coil is received by groove 30G of plunger 30 and its bottom coil is received by groove 26E of basket 26. If the spring force applied by spring 28 is overcome by the differential pressure under (that is to say on the vest side of) diaphragm 24, then basket 26 rises away from ridge 22A9 of base 22A thereby presenting a path for the escape of air from chamber 22A1.

The magnitude of the spring force applied by spring 28, and thus the differential pressure required to lift diaphragm 24 and basket 26 may be adjusted between a relatively high differential pressure to a relatively low differential pressure by rotating cap 22B from a position slightly offset from the closed position shown in FIG. 11 wherein a maximum spring force is applied, to the fully open position shown in FIG. 10 wherein a minimum spring force is applied. Since, in this example diaphragm 24 has an effective area of roughly 2.4 square inches, and since the spring constant is relatively small as noted above, the magnitude of the pressure differential needed to raise diaphragm 24 is relatively small even when pressure regulating unit 20 is in the working position shown in FIG. 10C. As noted above, when the applied spring force is at a maximum, then a larger differential pressure is needed to allow air to escape. In this example, the differential pressure required to lift diaphragm 24 when pressure regulating unit 20 is in the closed position (shown in FIG. 11) is greater than the pressure needed to open the relief valve in connector 42. When the spring force is at a minimum, such as when pressure regulating unit 20 is in the open position shown in FIG. 10A, then air will escape even when the differential pressure is relatively small.

Figure 8B:
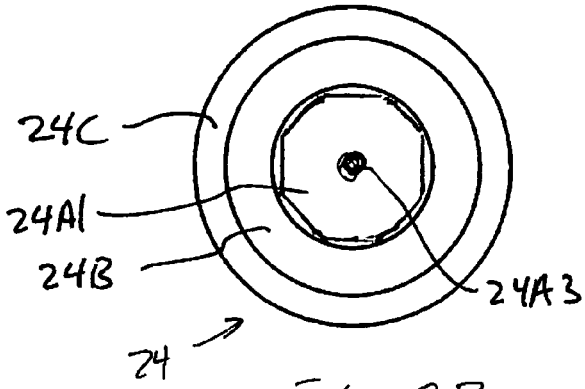
FIG. 8B is a top view of the diaphragm of a pressure regulating unit.
Figure 8D:
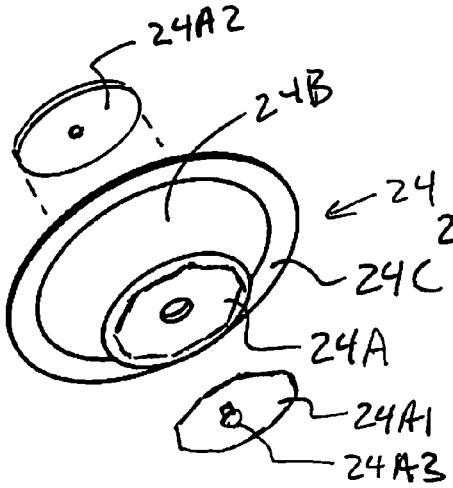
FIG. 8D is a perspective view of the diaphragm of a pressure regulating unit.
Figure 8A:
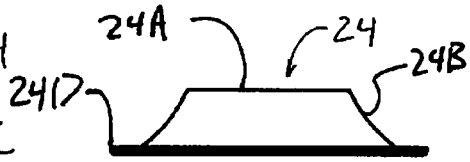
FIG. 8A is a side view of the diaphragm of a pressure regulating unit.
Figure 8C:
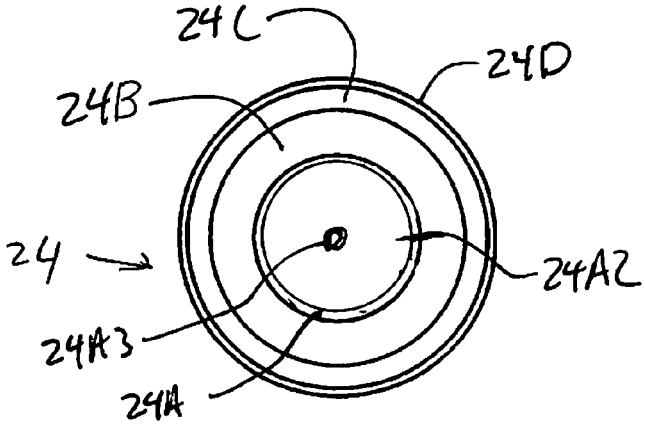
FIG. 8C is a bottom view of the diaphragm of a pressure regulating unit.
Figure 9C:
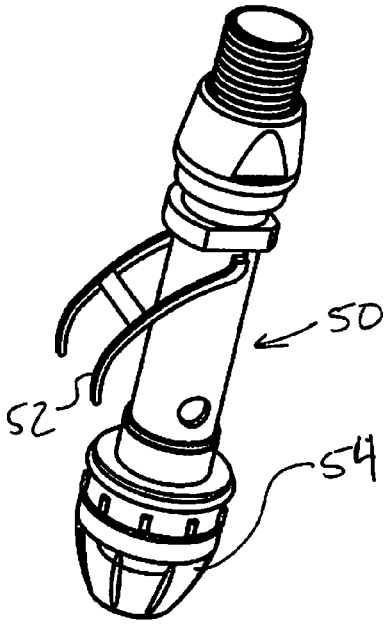
FIG. 9C is a perspective view of the air injection valve of a pressure regulating unit.
Figure 9D:
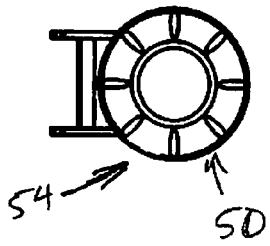
FIG. 9D is an end of the air injection valve of a pressure regulating unit.
Figure 9B:
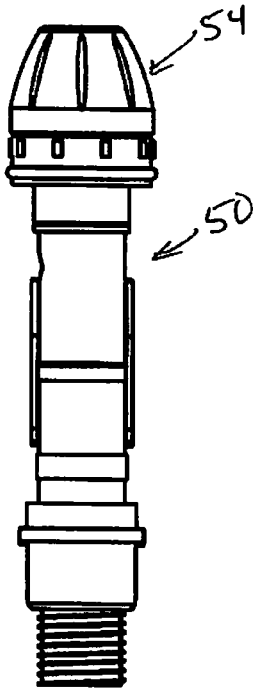
FIG. 9B is a top view of the air injection valve of a pressure regulating unit.
Figure 9A:
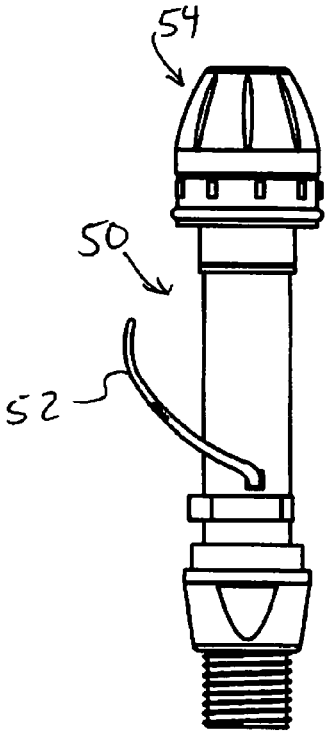
FIG. 9A is a side view of the air injection valve of a pressure regulating unit.

Injection valve 50 is a standard, adjustable second stage regulator valve of a type well known to scuba divers and others skilled in the art. In this example, as shown in FIGS. 8A-8D, diaphragm 24 is, in effect, a flexible member that is interposed between chamber 22A1 and the outside environment. In this example, diaphragm 24 has a generally thick rigid central disc portion 24A. Because the material used to fashion diaphragm 24 is so flexible, that, in order to have a rigid central disc portion 24A, which is preferred in this embodiment, it is necessary to stiffen disc portion 24A with rigid plastic. As is shown in FIG. 8D, in this example, upper and lower thin, rigid plastic discs 24A1 and 24A2 are fastened together by at least one central fastener 24A3 with the flexible material of disc portion 24A sandwiched between them. As can be seen in FIGS. 8A-8D, a thin flexible skirt 24B surrounds disc portion 24A which defines a shape that generally conforms to the partial inside surface of a ring torus. A thin, flat, flexible flange 24C extends from the outer edge of skirt 24B. In this example, the edge of flange 24C presents a bead 24D. When external water pressure is sufficiently greater than the pressure inside chamber 22A1, diaphragm 24 deflects inwardly toward lever 52 so that disc portion 24A (or more precisely lower rigid plastic disc 24A2 of disc portion 24A) touches lever 52 causing lever 52 to tilt and open injection valve 50 as shown in FIG. 10D. As noted above, injection valve 50 is normally closed until injection valve 50 is opened by tilting lever 52. An adjustment knob 54 may be rotated to adjust the amount of force needed to tilt lever 52 and thereby open valve 50. Thus, the amount of differential external pressure needed for diaphragm 24 to depress lever 52 to cause air from valve 50 to flow into the chambers of the vest may be adjusted by turning adjustment knob 54. Preferably, the range of adjustment is between a first position wherein a very small force will cause valve 50 to open to a second position wherein a substantial force is needed to cause valve 50 to open.

After the above discussion, it is now possible for the skilled reader to understand the various modes of operation for pressure regulating unit 20. Generally, these modes relate to whether or not the diver is descending or ascending, and whether the diver is generally level, upright or upside down.

Figures 12A, 12B, 12C, 12D:
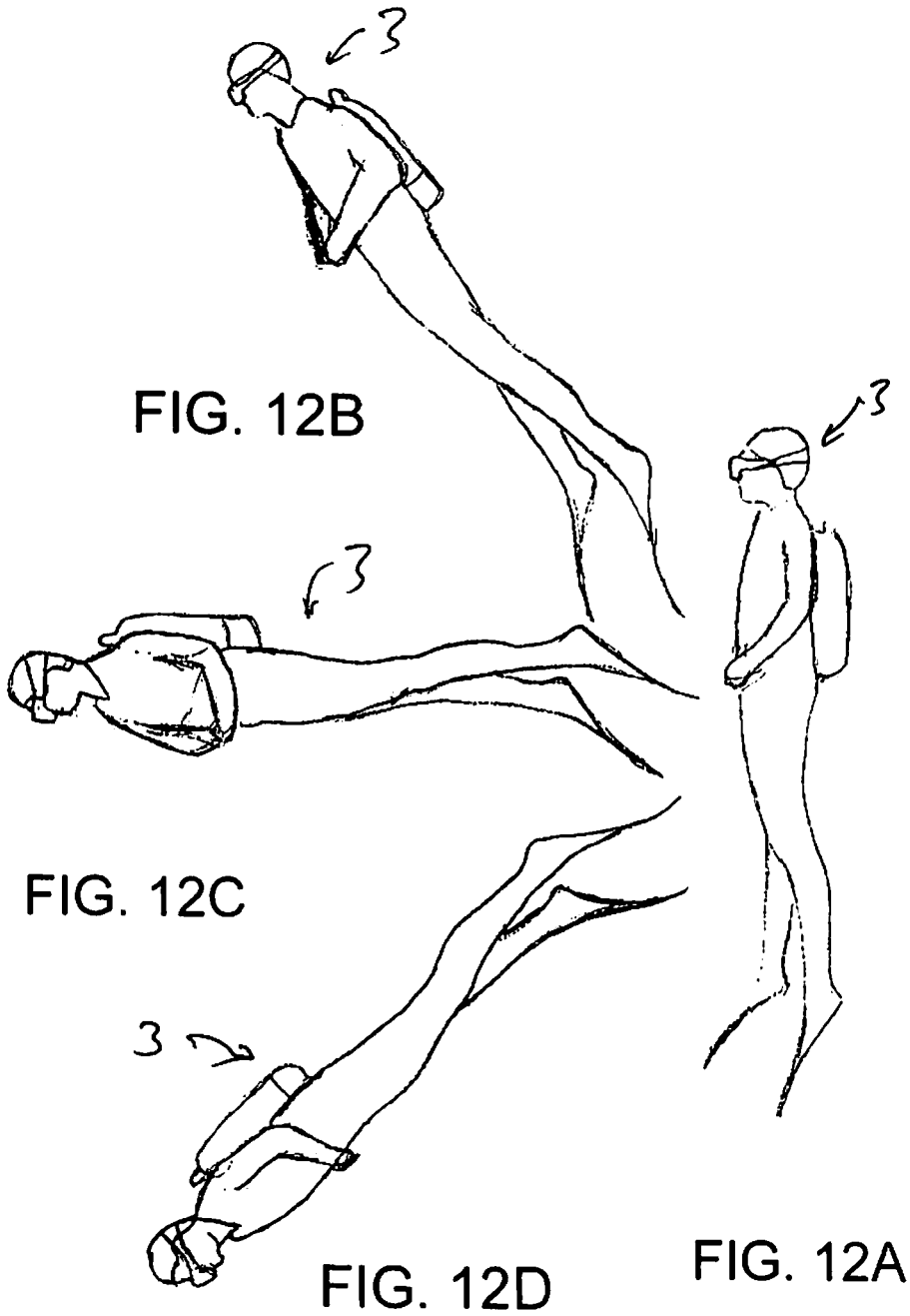
FIG. 12A is a side view of a SCUBA diver in an upright position.
FIG. 12B is a side view of a SCUBA diver in a partially upright position.
FIG. 12C is a side view of a SCUBA diver in a horizontal position which is a generally standard diving position particularly when a diver is at depth.
FIG. 12D is a side view of a SCUBA diver in a partially inverted position.

First, let us consider how regulating unit 20 functions when a diver is descending. Preferably, during a normal descent, a diver maintains a generally horizontal orientation as shown in FIG. 12C with his or her head perhaps a little lower than his or her feet. The best practice is for a diver to swim to a greater depth during a normal descent. It is not best practice for a diver to plunge to depth either head first or feet first. Because pressure regulating unit 20 is generally located at the upper left side of the BCD vest, generally near the diver's left shoulder, as shown in FIG. 1, pressure regulating unit 20 is approximately at the same level in the water column as air chambers 8 of vest 2 when the diver is descending. Further, we may assume the descent begins near the surface and the diver's buoyancy is generally neutral or perhaps slightly negative in order to facilitate the descent. Still further, we may assume pressure regulating unit 20 is set in a normal operating position as shown in FIG. 10B. As the diver descends, the water pressure surrounding air chambers 8 of vest 2 increases. Because the walls of air chambers 8 of vest 2 are not perfectly flexible, the relative air pressure inside chambers 8 of vest 2 becomes lower than the surrounding water pressure during this transient condition. If this continues, the walls of the air chambers of the vest will contract and the volume of the air in the BCD vest will decrease. A decrease in air chamber volume will cause the diver to lose buoyancy and sink faster. This might result in an unwanted runaway descent. But, before that happens, the positive differential pressure of the surrounding water causes diaphragm 24 to push in against lever 52 as shown in FIG. 10D. If the adjustment of lever 52 (accomplished by turning adjustment knob 54 as described above) is sufficiently light, lever 52 trips valve 50 open so that valve 50 injects air into chamber 22A1 and, in turn, into air chambers 8 of vest 2. This maintains the air chambers of the vest so that the volume of air in chambers 8 remains generally constant while the pressure inside the chambers 8 increases to generally correspond with the pressure of the surrounding water. This maintains the neutral buoyancy of the diver as the diver descends. What is described above for a normal descent is also true if the diver descends only a few feet in the water column, that is, if the diver descends enough to effect buoyancy. An injection of air as described above will occur to restore neutral buoyancy even if the diver descends just a few feet.

Let us now consider how pressure regulating unit 20 functions when a diver at depth executes a normal ascent. During a normal ascent, the diver will ascend generally head first in an upright position and, preferably, will do so gradually. After the descent described above, in order to maintain generally neutral buoyancy, air chambers 8 of vest 2 are filled with relatively high pressure air. If cap 22B of unit 20 were to be placed in the closed position shown in FIG. 11, air chambers 8 of vest 2 might expand as the diver ascends. This would result in increasing positive buoyancy for the diver and an unwanted buoyant ascent. Accordingly, during an ascent, cap 22B should be placed in position that is offset from the closed position shown in FIG. 11. On the other hand, having cap 22B in a wide open position as shown in FIG. 10A may not be beneficial during an ascent. So, again, during a normal ascent, pressure regulating unit 20 is preferably set in a position which is between the closed position shown in FIG. 11 and the open position shown in FIG. 10A, that is, in the normal operating position as shown in FIG. 10B. As noted above, the diver is ascending in the partially upright position shown in FIG. 12B or the upright position shown in FIG. 12A. Thus, pressure regulating unit 20 is located above most of air chambers 8 of vest 2. Because water pressure in the water column changes rapidly with depth and because air which has a much lower density than the surrounding water will seek a pathway to escape at the upper end of a submerged volume, a position with little or no spring pressure applied by spring 28 could result in an uncontrolled venting of the air from air chambers 8 of vest 2. Accordingly, it is preferable to have cap 22B in a position that is between the closed position and the wide open position prior to a normal ascent, that is in a position at least similar to operating position shown in FIG. 10B.

As noted above, during a normal ascent, the relative pressure of the vest air chambers rises as the diver moves up in the water column. When the differential positive pressure between chamber 22A1 and the outside water becomes sufficiently great, diaphragm 24 lifts away from ledge 22A9 of base 22 as shown in FIG. 10C. The gap between the underside of flange 24C of diaphragm 24 and ledge 22A9 of base 22A as shown in FIG. 10C is barely noticeable. But that gap is sufficient to allow the passage of escaping air around the periphery of diaphragm 24. This slight gap provides a pathway for air to escape from chamber 22A1 into the outside environment as described above. This flow of air continues until the positive pressure differential becomes sufficiently low that spring 28 overcomes the positive pressure and reseats the edge of diaphragm 24 thereby blocking the flow of air. Thus, as the diver ascends, air is gradually vented from air chambers 8 of vest 2 so that the volume of air chambers 8 remains generally constant. Accordingly, if the diver begins the ascent with generally neutral buoyancy, then neutral buoyancy is maintained throughout the ascent. Because air is gradually vented during the ascent, and buoyancy remains generally constant, buoyancy compensation apparatus 10 prevents a buoyant ascent. What is described above for a normal ascent is also true if the diver ascends only a few feet in the water column, that is, if the diver ascends enough to effect buoyancy. Any venting of air as described above will occur to restore neutral buoyancy even if the diver ascends just a few feet.

Another mode is addressed by buoyancy compensation apparatus 10. Occasionally, a diver may be oriented in an inverted position or a partially inverted position as shown in FIG. 12D. As can be seen with reference to FIG. 1, an inverted position will locate pressure regulating device 20 generally below air chambers 8 of vest 2. At this point, we must consider that water has a density that is over 400 times greater than the density of air even at moderate depths. Accordingly, the pressure throughout air chambers 8 of vest 2 is generally uniform from the upper ends of air chambers 8 to the lower ends of air chambers 8. However, the water pressure encountered by pressure regulating device 30 will be greater than the generally uniform pressure in chambers 8 if pressure regulating device is placed below the center of gravity of chambers 8 of vest 2. If injection valve 50 is adjusted to a light setting, such an orientation will cause positive external pressure to depress diaphragm 24, tilt lever 52 and cause air to be injected into vest 2. What happens next causes a problem for the diver. Since chambers 8 have some flexibility, chambers 8 expand until the air pressure inside chambers 8 matches the average water pressure surrounding chambers 8. When this adjustment occurs, the local water pressure around diaphragm 24 is again higher than the average air pressure in chambers 8. Once again, valve 50 opens and more air is injected into chambers 8 causing chambers 8 to expand. Thus, the diver's buoyancy tends to increase when the diver is in the inverted position.

Figure 3A:
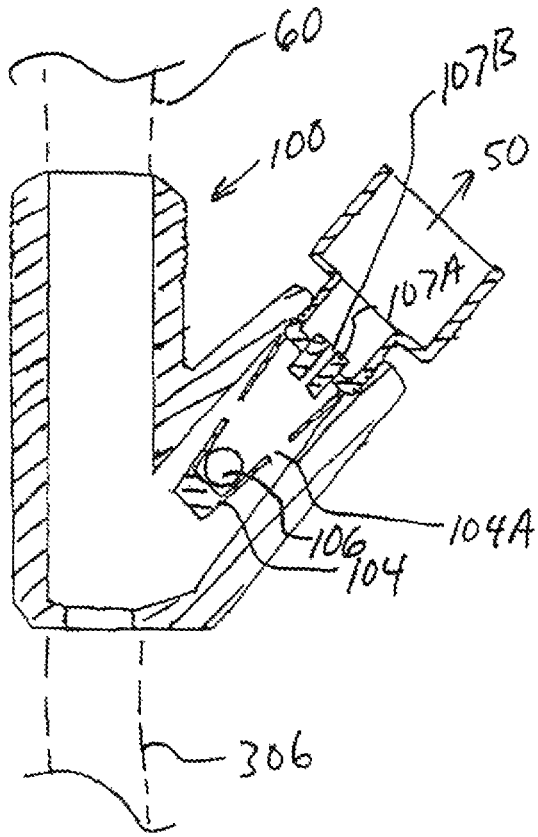
FIG. 3A is a first detailed cross-section view of an axis valve with the axis valve in an upright position.
Figure 3B:
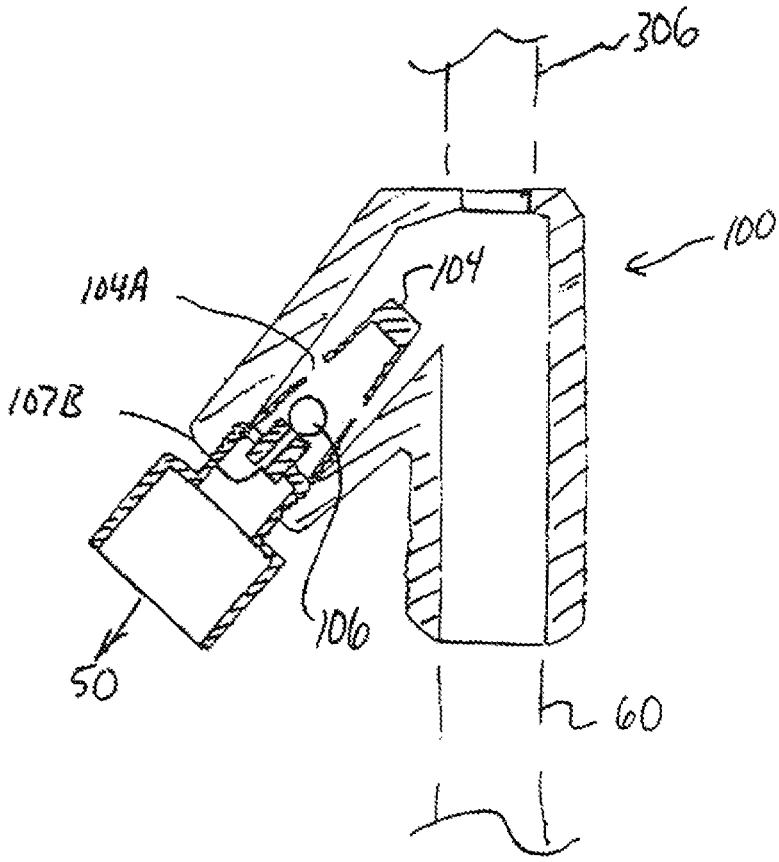
FIG. 3B is a second detailed cross-section view of an axis valve with the axis valve in an inverted position.

To counter the increase of buoyancy that would occur when diver 3 is in an inverted position, or at least partially inverted as shown in FIG. 12D, or in a left shoulder down position, buoyancy compensation apparatus 10 includes an axis valve 100 shown in FIG. 1 and shown in detail in FIGS. 3A and 3B. As can be seen in FIG. 1, axis valve 100 is connected to air line 60 which communicates with first stage regulator 6 and is further connected to valve 50 of pressure regulating unit 20. Axis valve 100 is arranged so that when diver 3 is in an inverted position or even when diver 3 is oriented with his left shoulder down (thereby placing pressure regulating unit 20 below most of air chambers 8 of vest 2), axis valve 100 greatly restricts the flow of air from air line 60 to valve 50. In this example, as can be seen in FIGS. 3A and 3B, axis valve 100 includes an internal chamber with an inlet that communicates with air line 60 and an outlet that communicates with valve 50 of pressure regulating unit 20. Axis valve 100 is shown in FIG. 3A in an upright position. Axis valve includes a cage 104 which holds a ball 106. At the upper end of cage 104 is an orifice member 107A having an orifice 107B which, together with side ports 104A in the walls of cage 104 presents pneumatic communication between the interior of axis valve 100 and inlet valve 50 of pressure control unit 20. Cage 104 also has a pocket for retaining ball 106 when axis valve 100 is in a normal, non-inverted position. The pocket is arranged so that when ball 106 is in the pocket, ball 106 is isolated from the air flowing through the cage and therefore not available to block orifice 107B. Orifice 107B is obstructed by ball 106 when axis valve 100 is in an inverted position as shown in FIG. 3B. A ball 106 nearly completely obstructs the valve chamber outlet when diver 3 is either in a generally head down position or in a left shoulder down position. That is, when pressure regulating unit 20 is beneath most of chambers 8. The resulting obstruction of air flow to valve 50 prevents the inflation of chambers 8 of vest 2 and the resulting unwanted increase in diver's buoyancy described above. If ball 106 and orifice 107B have smooth, corresponding surfaces, then ball 106 may become air locked to orifice 107B. Thus, it is preferable that either or both of ball 106 and the orifice 107B have ridges, grooves or other rough surface features so that a small amount of air can still pass around ball 106 when ball 106 is obstructing orifice 107B. This makes it possible for ball 106 to release from orifice 107B when the diver returns to level or upright diving position.

Figure 15A:
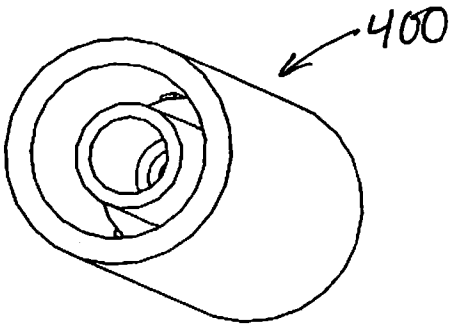
FIG. 15A is perspective view of a whistle that is placed in line 40 connecting the pressure regulating unit to the air chambers of the vest.
Figure 15C:
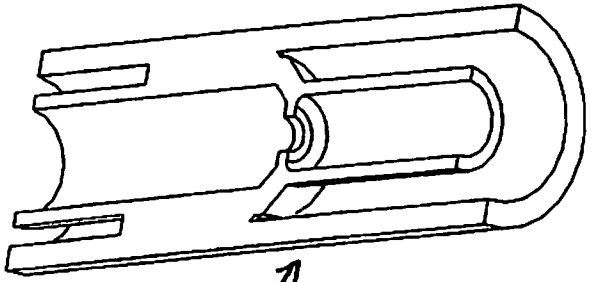
FIG. 15C is perspective cross-section view of the whistle that is placed in line 40 connecting the pressure regulating unit to the air chambers of the vest.
Figure 15B:
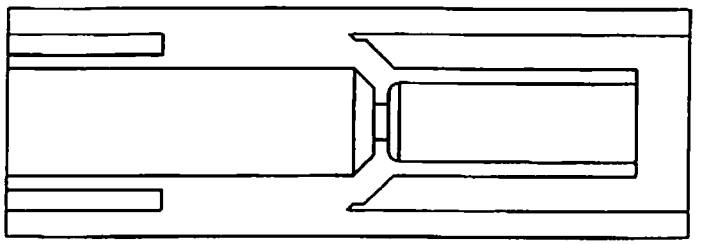
FIG. 15B is side cross-section view of the whistle that is placed in line 40 connecting the pressure regulating unit to the air chambers of the vest.

Optional whistle 400 shown in FIG. 2 provides an optional way of alerting a diver when air is being injected into chambers 8 of vest 2. Whistle 400, which is shown in greater detail in FIGS. 15A-15C, is preferably arranged and placed in line 40 shown in FIG. 1 in order to produce a soft high pitched sound when air is flowing through line 40 into vest 2. Accordingly, whistle 400 is a tone generating element that produces an audible tone when air flows from pressure regulating unit 20 to air chambers 8 of vest 2. The venting of air from vest 2 is easily perceived by the diver's bubbles emerging from the holes in plunger 30 of pressure regulating unit 20. However, without whistle 400, a diver might not perceive the injection of air into vest chambers 8. This is useful because a situation could arise in which a diver would not want air to be injected into vest 2 and in which a diver would want to know if that process is occurring.

Thus, with the above description, the skilled reader may understand how buoyancy compensation apparatus 10 will compensate for the changes in volume of air chambers 8 of vest 2 that would otherwise occur as diver 3 changes depth.

Most generally, pressure regulating unit 20 responds to a relative increase in pressure in air chambers 8 relative to surrounding water pressure, as would happen when a diver ascends, by permitting air to pass from chambers 8 to the outside environment thereby generally maintaining chambers 8 at a generally constant volume in order to maintain generally constant buoyancy as the diver ascends as described above. Conversely, when pressure in air chambers 8 drops below the surrounding water pressure, as would happen when a diver descends, pressure regulating device 20 responds by opening valve 50 and allowing air to pass from the first stage regulator into chamber 22A1 and from there into air chambers 8 of vest 2, thereby maintaining air chambers 8 at a generally constant volume in order to maintain generally constant buoyancy during a decent as described above. Thus, when adjusted properly, buoyancy compensation apparatus 10 provides a means for automatically maintaining generally constant buoyancy even as a diver changes depth.

It is to be understood that while certain forms of this invention have been illustrated and described, it is not limited thereto, except in so far as such limitations are included in the following claims and allowable equivalents thereof.

The invention claimed is:

1. A buoyancy compensation apparatus for use by a SCUBA diver who is diving in water having an ambient water pressure, the buoyancy compensation apparatus comprising:

(a) a source of pressurized air having a pressure greater than the ambient water pressure, (b) a buoyancy vest including at least one air chamber enclosed by walls sufficiently flexible to allow the volume of the air chamber to change, (c) a pressure regulating unit which is in communication with the at least one air chamber of the buoyancy vest, the pressure regulating unit having a pressure relief portion which opens to allow air to escape from the at least one air chamber of the buoyancy vest when the pressure in the at least one air chamber of the buoyancy vest rises above the ambient water pressure, the pressure regulating unit also having an air injection valve in communication with the source of pressurized air and a flexible pressure sensitive member interposed between the surrounding water and a chamber which is in communication with the at least one air chamber of the buoyancy vest, the flexible pressure sensitive member arranged to flex and open the air injection valve when the ambient water pressure rises above the pressure in the at least one air chamber of the buoyancy vest such that pressurized air is injected into the at least one air chamber of the buoyancy vest, and, (d) an axis valve located between the source of pressurized air and the injection valve of the pressure regulating unit, the axis valve having a portion that obstructs the axis valve when the diver is oriented so that the pressure regulating unit is beneath at least most of the at least one air chamber of the buoyancy vest.

2. The buoyancy compensation apparatus of, claim 1 wherein:

the air injection valve is adjustable so that it is possible to adjust the force required to open it.

3. The buoyancy compensation apparatus of, claim 1, wherein:

the pressure relief portion is adjustable so that it is possible to adjust the force required to open it.

4. The buoyancy compensation apparatus of claim 1, wherein:

the air injection valve is adjustable so that it is possible to adjust the force required to open the air injection valve and the pressure relief portion is adjustable so that it is possible to adjust the force required to open the pressure relief portion.

5. A buoyancy compensation apparatus for use by a SCUBA diver in a body of water at a diving depth, the diver being surrounded by water which has an ambient water pressure, the buoyancy compensation apparatus comprising:

(a) a source of pressurized air having a pressure greater than the ambient water pressure, (b) a buoyancy vest including at least one air chamber enclosed by walls sufficiently flexible to allow the volume of the at least one air chamber to change, (c) a pressure relief portion which opens to allow air to escape from the at least one air chamber of the buoyancy vest when the pressure in the at least one air chamber of the buoyancy vest rises above the ambient water pressure, the release of air from the at least one air chamber of the buoyancy vest in response to decreasing ambient water pressure occurring sufficiently rapidly to prevent at least most of the expansion of the at least one chamber of the buoyancy vest that would otherwise occur in response decreasing ambient water pressure, whereby a diver using the buoyancy compensation apparatus will automatically experience at least a reduced rate of increasing buoyancy when ascending, and, (d) an air injection portion including an air injection valve connected to the source of pressurized air and which at least indirectly communicates with the at least one air chamber of the buoyancy vest, the air injection portion arranged to inject air into the at least one air chamber of the buoyancy vest when ambient water pressure rises above the pressure in the at least one air chamber of the buoyancy vest, the injection of air into the at least one air chamber of the buoyancy vest occurring sufficiently rapidly to prevent at least most of the contraction of the at least one air chamber of the buoyancy that would otherwise occur in response to increasing ambient water pressure, whereby a diver using the buoyancy compensation apparatus will automatically experience at least a reduced rate of decreasing buoyancy when descending, and, (e) an axis valve located between the source of pressurized air and the air injection portion, the axis valve having a portion that obstructs the axis valve when the diver is oriented so the air injection portion is beneath at least most of the at least one air chamber of the buoyancy vest.

6. The buoyancy compensation apparatus of claim 5, wherein;

the air injection portion includes an air injection valve, a chamber in communication with the at least one chamber of the buoyancy vest and a pressure sensitive member interposed between the surrounding water and the chamber, the pressure sensitive member being mechanically associated with the air injection valve such that an increase of the ambient water pressure relative to the air pressure in the chamber causes the pressure sensitive member to deflect and cause the air injection valve to open in order to inject air into the chamber and thereby transfer air into the at least one chamber of the buoyancy vest.

7. The buoyancy compensation apparatus of claim 6, wherein;

the pressure sensitive member is a flexible rubber diaphragm.

8. The buoyancy compensation apparatus of claim 6, wherein;

the air injection portion and the pressure relief portion are combined in a pressure regulating unit such that the pressure sensitive member is a flexible rubber diaphragm which is also sealed to the chamber of the air injection portion, the seal being openable when the pressure in the chamber and by extension the pressure in the at least one air chamber of the buoyancy vest rises above the ambient water pressure, whereby air is released around the open seal into the surrounding water to limit the expansion of the at least one air chamber of the buoyancy vest when the diver ascends.

9. The buoyancy compensation apparatus of claim 5, wherein;

the pressure relief portion is adjustable such that the amount of pressure differential between the at least one chamber of the buoyancy vest and the surrounding water required to open the pressure relief portion is adjustable.

10. The buoyancy compensation apparatus of claim 5, wherein;

the air injection portion is adjustable such that the amount of pressure differential between the at least one chamber of the buoyancy vest and the required to open the air injection valve is adjustable.

11. The buoyancy compensation apparatus of claim 5, wherein;

the pressure relief portion is adjustable such that the amount of pressure differential between the at least one chamber of the buoyancy vest and the surrounding water required to open the pressure relief portion is adjustable, and, the air injection portion is adjustable such that the amount of pressure differential between the at least one chamber of the buoyancy vest and the surrounding water required to open the air injection valve is adjustable.

12. A buoyancy compensation apparatus for use by a SCUBA diver in a body of water at a diving depth, the diver being surrounded by water which has an ambient water pressure, the buoyancy compensation apparatus comprising:

(a) a source of pressurized air having a pressure greater than the ambient water pressure, (b) a buoyancy vest including at least one air chamber enclosed by walls sufficiently flexible to allow the volume of the at least one air chamber to expand or contract, (c) a pressure regulating unit which is in communication with the at least one air chamber of the buoyancy vest, the pressure regulating unit having a pressure relief portion and an air injection portion, the pressure relief portion arranged to open to allow air to escape from the at least one air chamber of the buoyancy vest when the pressure in the at least one air chamber of the buoyancy vest rises above the ambient water pressure, the air injection portion having an injection valve in communication with the source of pressurized air and a flexible member between the surrounding water and a chamber which is in communication with the at least one chamber of the buoyancy vest and mechanically associated with the injection valve such that when the ambient water pressure rises above the pressure in the chamber and the at least one air chamber of the buoyancy vest, the flexible member deflects and causes the injection valve to open thereby injecting air into the at least one air chamber of the buoyancy vest, the release of air from or the injection of air into the at least one air chamber of the buoyancy vest in response to changing ambient water pressure occurring sufficiently rapidly to prevent at least most of the expansion or contraction of the at least one air chamber of the buoyancy vest that would otherwise occur in response changing ambient water pressure, whereby a diver using the buoyancy compensation apparatus will automatically experience at least a reduced rate of change in buoyancy when ascending or descending, and, (d) an axis valve located between the source of pressurized air and the injection valve of the air injection portion, the axis valve having a portion that obstructs the axis valve when the diver is oriented so that the chamber of the air injection portion is beneath at least most of the at least one air chamber of the buoyancy vest.

13. The buoyancy compensation apparatus of claim 12, wherein;

the pressure relief portion is adjustable such that the amount of pressure differential between the at least one chamber of the buoyancy vest and the surrounding water required to open the pressure relief portion is adjustable.

14. The buoyancy compensation apparatus of claim 12, wherein;

the air injection portion is adjustable such that the amount of pressure differential between the at least one chamber of the buoyancy vest and the surrounding water required to open the air injection valve is adjustable.

15. The buoyancy compensation apparatus of claim 12, wherein;

the pressure relief portion is adjustable such that the amount of pressure differential between the at least one chamber of the buoyancy vest and the surrounding water required to open the pressure relief portion is adjustable, and, the air injection portion is adjustable such that the amount of pressure differential between the at least one chamber of the buoyancy vest and the surrounding water required to open the air injection valve is adjustable.

* * * * *